US010532598B2

(12) United States Patent
Ng et al.

(10) Patent No.: US 10,532,598 B2
(45) **Date of Patent: *Jan. 14, 2020**

(54) RING BINDER MECHANISM

(71) Applicant: World Wide Stationery Mfg. Co., Ltd., Hong Kong (CN)

(72) Inventors: Wing Yiu Ng, Hong Kong (CN); Hung Yu Cheng, Hong Kong (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 593 days.

This patent is subject to a terminal disclaimer.

(21) Appl. No.: 14/713,871

(22) Filed: May 15, 2015

(65) Prior Publication Data

US 2015/0246572 A1 Sep. 3, 2015

Related U.S. Application Data

(63) Continuation of application No. 13/481,824, filed on May 26, 2012, now Pat. No. 9,044,994, which is a (Continued)

(51) Int. Cl.

| | |
|---|---|
| ***B42F 13/26*** | (2006.01) |
| ***B42F 3/04*** | (2006.01) |
| ***B42F 13/36*** | (2006.01) |

(52) U.S. Cl.

CPC ..... *B42F 13/26* (2013.01); *B42F 3/04* (2013.01); *B42F 13/36* (2013.01)

(58) Field of Classification Search

CPC ..... B42F 13/16; B42F 13/20; B42F 13/22; B42F 13/26

See application file for complete search history.

(56) References Cited

U.S. PATENT DOCUMENTS

| | | | |
|---|---|---|---|
| 419,160 | A | 1/1890 | Smith |
| 566,717 | A | 8/1896 | Krah |

(Continued)

FOREIGN PATENT DOCUMENTS

| | | | |
|---|---|---|---|
| CA | 2500817 | A1 | 9/2005 |
| EP | 1431065 | A1 | 6/2004 |

(Continued)

OTHER PUBLICATIONS

Kokuyo Lock Ring Mechanism with description, two instruction sheets, and nine photographs, date unknown but admitted as prior art, 12 pages.

(Continued)

*Primary Examiner* — Matthew Katcoff
(74) *Attorney, Agent, or Firm* — Stinson LLP

(57) ABSTRACT

A ring mechanism has pivoting hinge plates supported by a housing so pivoting of the hinge plates can open and close rings for holding the loose-leaf pages. The mechanism has an actuator including a lower arm for moving the hinge plates to open the rings and an upper arm for moving the hinge plates to close the rings. The upper arm has a hook thereon. An intermediate connector comprises a cross bar captured by the hook on the actuator. The intermediate connector connects a travel bar to the actuator so movement of the actuator to pivot the hinge plates causes longitudinal movement of the travel bar in the housing. A locking element is moveable with the travel bar between a locking position and non-locking position.

17 Claims, 54 Drawing Sheets

Related U.S. Application Data continuation of application No. 12/789,031, filed on May 27, 2010, now Pat. No. 8,186,899, which is a continuation of application No. 11/681,590, filed on Mar. 2, 2007, now Pat. No. 7,731,441.

(60) Provisional application No. 60/827,205, filed on Sep. 27, 2006.

(56) References Cited

U.S. PATENT DOCUMENTS

| | | | |
|---|---|---|---|
| 621,256 | A | 3/1899 | Krah |
| 651,254 | A | 6/1900 | Krah |
| 683,019 | A | 9/1901 | Buchanan |
| 779,879 | A | 1/1905 | Sheridan et al. |
| 790,382 | A | 5/1905 | McBride |
| 854,074 | A | 5/1907 | Bryant |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,598,206 | A | 8/1926 | Lindstedt et al. |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,824,791 | A | 9/1931 | Rengmann |
| 1,857,291 | A | 5/1932 | Trussell |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,075,767 | A | 3/1937 | Rand |
| 2,081,372 | A | 5/1937 | Thomas |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna et al. |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil, Sr. |
| 2,552,076 | A | 5/1951 | Wedge |
| 2,570,323 | A | 10/1951 | Condon et al. |
| 2,612,169 | A | 9/1952 | Segal |
| 2,789,561 | A | 4/1957 | Bonn et al. |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe et al. |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,222,679 | A | 9/1980 | Luogameno |
| 4,352,582 | A | 10/1982 | Eliasson |
| 4,486,112 | A | 12/1984 | Cummins |
| 4,522,526 | A | 6/1985 | Lozfau et al. |
| 4,566,817 | A | 1/1986 | Barrett, Jr. |
| 4,571,108 | A | 2/1986 | Vogl |
| 4,690,580 | A | 9/1987 | Kissel |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,620,206 | A | 4/1997 | Flores |
| 5,634,666 | A | 6/1997 | Lee |
| 5,651,628 | A | 7/1997 | Bankes et al. |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,924,811 | A | 7/1999 | To et al. |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To et al. |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |

(56) References Cited

U.S. PATENT DOCUMENTS

| | | | |
|---|---|---|---|
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,275,886 | B2 | 10/2007 | Cheng |
| 7,296,946 | B2 | 11/2007 | Cheng et al. |
| 7,404,685 | B2 | 7/2008 | Cheng |
| 7,478,963 | B2 | 1/2009 | Tanaka et al. |
| 7,491,006 | B2 | 2/2009 | Whaley |
| 7,524,127 | B2 | 4/2009 | Petrie et al. |
| 7,524,128 | B2 | 4/2009 | Cheng |
| 7,530,755 | B2 | 5/2009 | Whaley |
| 7,534,064 | B2 | 5/2009 | Cheng |
| 7,549,817 | B2 | 6/2009 | Cheng et al. |
| 7,648,302 | B2 | 1/2010 | Zhang et al. |
| 7,661,898 | B2 | 2/2010 | Ng et al. |
| 7,661,899 | B2 | 2/2010 | Lin |
| 7,665,926 | B2 | 2/2010 | Cheng |
| 7,674,062 | B2 | 3/2010 | Horn |
| 7,704,005 | B2 | 4/2010 | Lin |
| 7,726,897 | B2 | 6/2010 | To et al. |
| 7,731,441 | B2 | 6/2010 | Ng et al. |
| 7,748,922 | B2 | 7/2010 | Cheg |
| 7,950,867 | B2 | 5/2011 | Lin |
| 8,052,343 | B2 | 11/2011 | Zhang et al. |
| 8,186,899 | B2 | 5/2012 | Ng et al. |
| 9,180,721 | B2 | 11/2015 | Lin |
| 2003/0044221 | A1 | 3/2003 | To et al. |
| 2005/0201818 | A1 | 9/2005 | Cheng |
| 2005/0207826 | A1 | 9/2005 | Cheng et al. |
| 2006/0008318 | A1 | 1/2006 | Ng |
| 2006/0056906 | A1 | 3/2006 | Horn |
| 2006/0147254 | A1 | 7/2006 | Cheng |
| 2006/0251467 | A1 | 11/2006 | Cheng |
| 2007/0086836 | A1 | 4/2007 | Cheng |
| 2007/0140780 | A1 | 6/2007 | Petrie et al. |
| 2008/0075527 | A1 | 3/2008 | Pi et al. |
| 2009/0035053 | A1 | 2/2009 | Pi et al. |
| 2009/0060631 | A1 | 3/2009 | To et al. |
| 2009/0110469 | A1 | 4/2009 | To et al. |
| 2011/0170942 | A1 | 7/2011 | Huang et al. |
| 2013/0287476 | A1 | 10/2013 | Huang |
| 2014/0140754 | A1 | 5/2014 | Whaley |
| 2014/0186094 | A1 | 7/2014 | Lin |
| 2014/0348570 | A1 | 11/2014 | Whaley |

FOREIGN PATENT DOCUMENTS

| | | | |
|---|---|---|---|
| FR | 1336765 | A | 9/1963 |
| FR | 1346864 | A | 12/1963 |
| FR | 2221924 | | 10/1974 |
| FR | 2238332 | A5 | 2/1975 |
| GB | 837875 | | 6/1960 |
| GB | 868724 | | 5/1961 |
| GB | 906279 | | 9/1962 |
| GB | 952536 | | 3/1964 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 1299095 | A | 12/1989 |
| JP | 02-034289 | U1 | 3/1990 |
| JP | 4120085 | U | 10/1992 |
| JP | 10-217662 | A | 8/1998 |
| JP | 2004098417 | A | 4/2004 |
| WO | 2013026351 | A1 | 2/2013 |

OTHER PUBLICATIONS

Office action dated Oct. 15, 2009 in related U.S. Appl. No. 11/697,556, 6 pages.

Response filed Nov. 16, 2009 to Office Action dated Oct. 15, 2009 in related U.S. Appl. No. 11/697,556, 8 pages.

Office action dated Mar. 12, 2010 in related U.S. Appl. No. 11/697,556, 10 pages.

Response filed Jun. 29, 2010 to Office Action dated Mar. 12, 2010 in related U.S. Appl. No. 11/697,556, 18 pages.

Office action dated Oct. 20, 2010 in related U.S. Appl. No. 11/697,556, 11 pages.

Response filed Jan. 6, 2011 to Office Action dated Oct. 20, 2011 in related U.S. Appl. No. 11/697,556, 16 pages.

Office action dated Mar. 16, 2011 in related U.S. Appl. No. 11/697,556, 7 pages.

Response filed Jun. 16, 2011 to Office Action dated Mar. 16, 2011 in related U.S. Appl. No. 11/697,556, 16 pages.

European Search Report dated May 5, 2009 in related Application Serial No. EP 07112561.1, 5 pages.

Office action dated Apr. 13, 2009 in related U.S. Appl. No. 11/681,590, 6 pages.

Response filed May 6, 2009 to Office Action dated Apr. 13, 2009 in related U.S. Appl. No. 11/681,590, 1 page.

Office action dated Jun. 26, 2009 in related U.S. Appl. No. 11/681,590, 11 pages.

Response filed Oct. 21, 2009 to Office Action dated Jun. 26, 2009 in related U.S. Appl. No. 11/681,590, 20 pages.

European Search Report dated May 18, 2009 in related Application Serial No. EP 07112577.7, 7 pages.

Office action dated Mar. 19, 2008 in related U.S. Appl. No. 11/610,358, 16 pages.

Response filed Jun. 19, 2008 to Office Action dated Mar. 19, 2008 in related U.S. Appl. No. 11/610,358, 21 pages.

Office action dated Oct. 24, 2008 in related U.S. Appl. No. 11/610,358, 11 pages.

Response filed Jan. 26, 2009 to Office Action dated Oct. 24, 2008 in related U.S. Appl. No. 11/610,358, 11 pages.

Advisory Action dated Feb. 27, 2009 in related U.S. Appl. No. 11/610,358, 4 pages.

Appeal Brief filed Jul. 24, 2009 in response to Office action dated Oct. 24, 2008 in related U.S. Appl. No. 11/610,358, 40 pages.

Office action dated May 21, 2010 in related U.S. Appl. No. 12/502,657, 15 pages.

Response filed Sep. 21, 2010 to Office Action dated May 21, 2010 in related U.S. Appl. No. 12/502,657, 22 pages.

Office action dated Dec. 10, 2010 in related U.S. Appl. No. 12/502,657, 17 pages.

Appeal Brief filed May 10, 2011 in response to Office action dated Dec. 10, 2010 in related U.S. Appl. No. 12/502,657, 47 pages.

European Search Report dated May 15, 2009 in related Application Serial No. EP 07112563.7, 8 pages.

Office action dated Nov. 2, 2010 in related U.S. Appl. No. 12/789,031, 10 pages.

Response filed Mar. 2, 2011 to Office Action dated Nov. 2, 2010 in related U.S. Appl. No. 12/789,031, 12 pages.

Office action dated Jul. 27, 2012 in related U.S. Appl. No. 13/481,824, 10 pges.

Response filed Jan. 28, 2013 to Office Action dated Jul. 27, 2012 in related U.S. Appl. No. 13/481,824 , 7 pages.

Office action dated Mar. 13, 2013 in related U.S. Appl. No. 13/481,824, 11 pages.

Response filed Sep. 13, 2013 to Office Action dated Mar. 13, 2013 in related U.S. Appl. No. 13/481,824, 9 pages.

Office action dated Nov. 5, 2013 in related U.S. Appl. No. 13/481,824, 10 pages.

Response filed May 5, 2014 to Office Action dated Nov. 5, 2013 in related U.S. Appl. No. 13/481,824, 11 pages.

Office action dated Jul. 7, 2014 in related U.S. Appl. No. 13/481,824, 16 pages.

Response filed Sep. 30, 2014 to Office Action dated Jul. 7, 2014 in related U.S. Appl. No. 13/481,824, 16 pages.

Office action dated Nov. 18, 2014 in related U.S. Appl. No. 13/481,824, 16 pages.

Response filed Jan. 20, 2015 to Office Action dated Nov. 18, 2014 in related U.S. Appl. No. 13/481,824, 10 pages.

(56) References Cited

OTHER PUBLICATIONS

Office action dated Mar. 14, 2017 in related U.S. Appl. No. 14/449,900, 7 pages.
Response filed Apr. 27, 2017 to Office Action dated Mar. 14, 2017 in related U.S. Appl. No. 14/449,900, 10 pages.

RING BINDER MECHANISM

CROSS-REFERENCE TO RELATED APPLICATION

This application is a continuation of U.S. application Ser. No. 13/481,824, filed May 26, 2012, which is a continuation of U.S. application Ser. No. 12/789,031, filed May 27, 2010, now U.S. Pat. No. 8,186,899, issued May 29, 2012, which is a continuation of U.S. Pat. No. 7,713,441, filed Mar. 2, 2007, and issued Jun. 8, 2010, and which also claims the benefit of U.S. Provisional Application No. 60/827,205, filed Sep. 27, 2006, all of which are hereby incorporated by reference.

BACKGROUND OF THE INVENTION

This invention relates to a ring binder mechanism for retaining loose-leaf pages, and in particular to an improved ring binder mechanism for opening and closing ring members and for locking closed ring members together.

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis. An elongate housing loosely supports the hinge plates within the housing and holds the hinge plates together so they may pivot relative to the housing.

The undeformed housing is slightly narrower than the joined hinge plates when the hinge plates are in a coplanar position (180°). So as the hinge plates pivot through this position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers may also be provided on one or both ends of the housing for moving the ring members between the open and closed positions. But a drawback to these known ring binder mechanisms is that when the ring members are closed, they do not positively lock together. So if the mechanism is accidentally dropped, the ring members may unintentionally open.

Some ring binder mechanisms have been modified to include locking structure to block the hinge plates from pivoting when the ring members are closed. The blocking structure positively locks the closed ring members together, preventing them from unintentionally opening if the ring mechanism is accidentally dropped. The blocking structure also allows the housing spring force to be reduced because the strong spring force is not required to clamp the closed ring members together. Thus, less operator force is required to open and close the ring members of these mechanisms than in traditional ring mechanisms.

Some of these ring mechanisms incorporate the locking structure onto a control slide connected to the lever. The lever moves the control slide (and its locking structure) to either block the pivoting movement of the hinge plates or allow it. But a drawback to these mechanisms is that an operator must positively move the lever after closing the ring members to position the locking structure to block the hinge plates and lock the ring members closed. Failure to do this could allow the hinge plates to inadvertently pivot and open the ring members, especially if the mechanisms are accidentally dropped.

Some locking ring binder mechanisms use springs to move the locking structure into position blocking the hinge plates when the ring members close. Examples are shown in co-assigned U.S. patent application Ser. No. 10/870,801 (Cheng et al.), Ser. No. 10/905,606 (Cheng), and Ser. No. 11/027,550 (Cheng). These mechanisms employ separate springs to help lock the mechanisms.

Movement of the locking structure is generally linear or translational, but the movement is actuator by pivoting of a lever. Accordingly, there is a need to transfer only the translational component of the lever's motion to the locking structure. There are solutions that have been proposed. For example, refer to co-owned U.S. patent application Ser. No. 10/870,801. However, there is a need to accomplish the transmission of motion with structure which is inexpensive to manufacture, simple in overall construction, and reliable in repeated operation.

SUMMARY OF THE INVENTION

One aspect of the invention is a ring mechanism for retaining loose leaf pages. The mechanism has an elongate housing. First and second hinge plates are supported by the housing for pivoting motion relative to the housing. The mechanism has rings for holding the loose-leaf pages. Each ring includes a first ring member and a second ring member. The first ring member is moveable with the pivoting motion of the first hinge plate relative to the second ring member between a closed position and an open position. In the closed position the two ring members form a substantially continuous, closed loop for allowing loose-leaf pages retained by the rings to be moved along the rings from one ring member to the other. In the open position the two ring members form a discontinuous, open loop for adding or removing loose-leaf pages from the rings. An actuator is mounted on the housing for movement relative to the housing for causing pivoting motion of the hinge plates to open the rings. The actuator has a lower arm for moving the hinge plates to open the rings and an upper arm for moving the hinge plates to close the rings. The upper arm of the actuator has a hook thereon. The mechanism has a travel bar and an intermediate connector connecting the travel bar to the actuator so movement of the actuator to pivot the hinge plates causes longitudinal movement of the travel bar in the housing. A locking element is moveable with the travel bar between a locking position in which the locking element blocks movement of the hinge plates to open the rings and non-locking position in which the locking element does not block pivoting movement of the hinge plates to open the rings. The intermediate connector has a cross bar captured by the hook on the actuator.

One aspect of the invention is a ring mechanism for retaining loose leaf pages. The mechanism has an elongate housing. First and second hinge plates are supported by the housing for pivoting motion relative to the housing. The mechanism has rings for holding the loose-leaf pages. Each ring includes a first ring member and a second ring member. The first ring member is moveable with the pivoting motion of the first hinge plate relative to the second ring member between a closed position and an open position. In the closed position the two ring members form a substantially continuous, closed loop for allowing loose-leaf pages retained by the rings to be moved along the rings from one ring member to the other. In the open position the two ring members form a discontinuous, open loop for adding or removing loose-leaf pages from the rings. An actuator is mounted on the housing for movement relative to the housing for causing pivoting motion of the hinge plates to open the rings. The mechanism has a travel bar and intermediate connector connecting the travel bar to the actuator so movement of the actuator to pivot the hinge plates causes longitudinal movement of the travel bar in the housing. The intermediate connector and travel bar are formed as one piece of material and having a living hinge adapted to allow the intermediate connector to pivot relative to the travel bar. A locking element is moveable with the travel bar between a locking position in which the locking element blocks movement of the hinge plates to open the rings and non-locking position in which the locking element does not block pivoting movement of the hinge plates to open the rings. The living hinge is constructed to maintain a substantially constant spacing between the intermediate connector and the travel at points of connection of the living hinge to the intermediate connector and travel bar.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
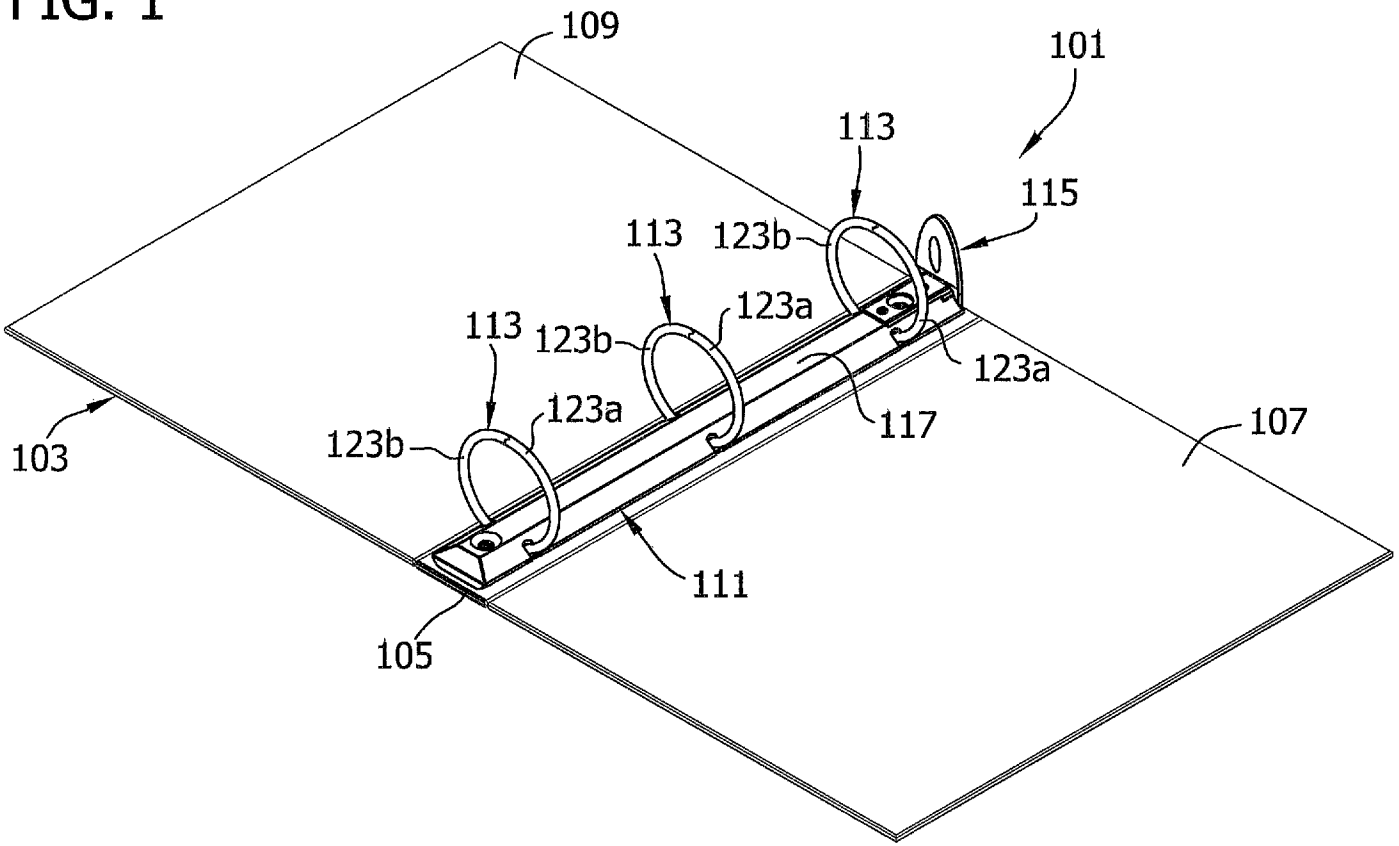
FIG. 1 is a perspective of a notebook incorporating a ring binder mechanism of the present invention.

Referring to the drawings, FIGS. 1-16 show a ring binder mechanism generally at 101. In FIG. 1, the mechanism 101 is shown mounted on a notebook designated generally at 103. Specifically, the mechanism 101 is shown mounted on a spine 105 of the notebook 103 between a front cover 107 and a back cover 109 hingedly attached to the spine 103. The front and back covers 107, 109 move to selectively cover or expose loose-leaf pages (not shown) retained by the mechanism 101 in the notebook 103. Ring binder mechanisms mounted on notebooks in other ways or on surfaces other than a notebook, for example, a file, do not depart from the scope of this invention.

Figure 2:
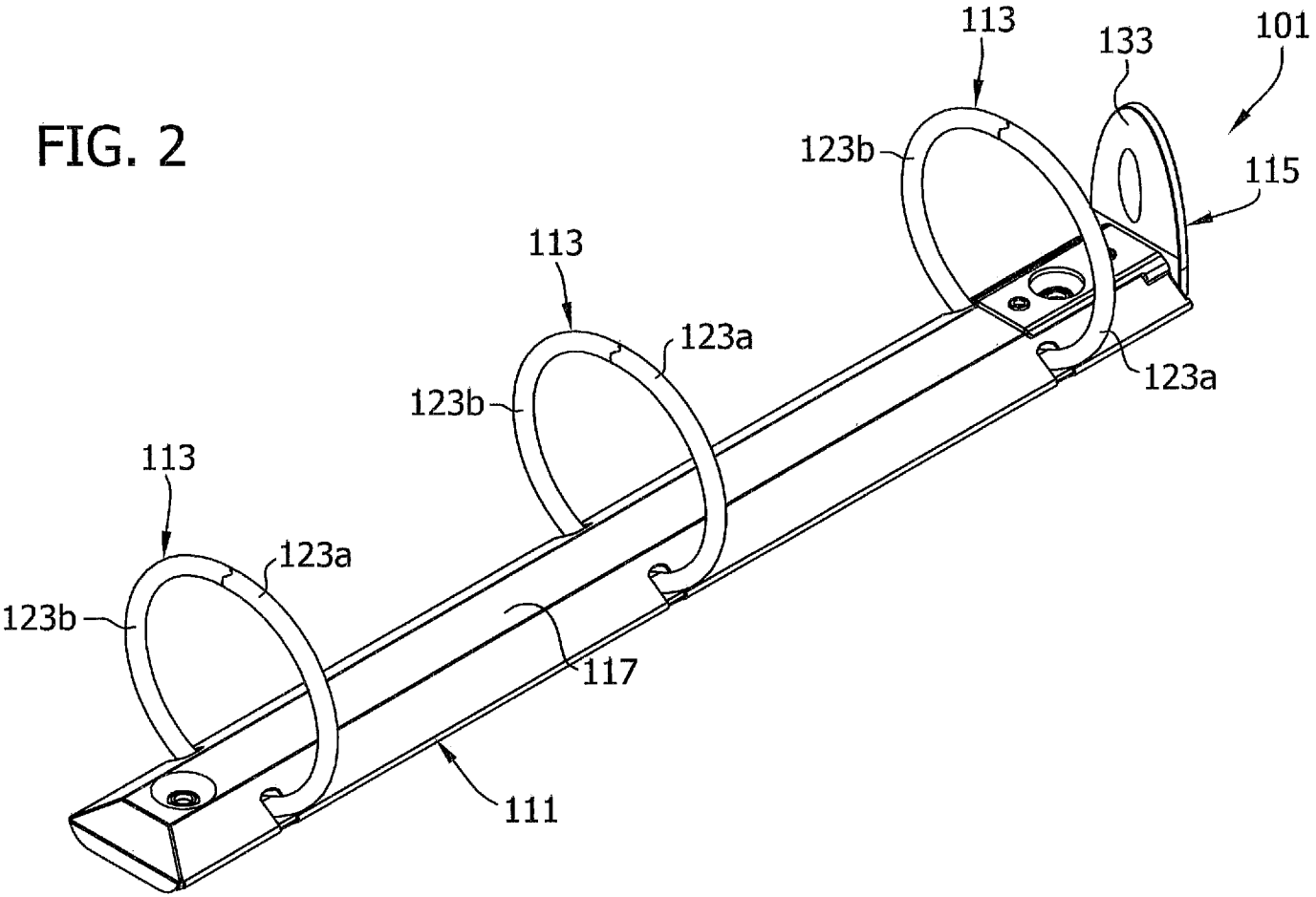
FIG. 2 is a top side perspective of the ring binder mechanism at a closed and locked position and with the lever in a first relaxed position.

As shown in FIG. 1, a housing, designated generally at 111, supports three rings (each designated generally at 113) and a lever (broadly, "actuator," and designated generally at 115). The lever is attached to the housing via a pin 161. The rings 113 retain loose-leaf pages on the ring mechanism 101 in the notebook 103 while the lever 115 operates to open and close the rings so that pages may be added or removed. Referring now also to FIG. 2, the housing 111 is shaped as an elongated rectangle with a uniform, roughly arch-shaped cross section, having at its center a generally flat plateau 117. A first longitudinal end of the housing 111 (to the right in FIG. 2) is generally open while a second, opposite longitudinal end (to the left in FIG. 2) is generally closed. Bent under rims, each designated at 121 (FIG. 4), extend lengthwise along longitudinal edges of the housing 111 from the first longitudinal end of the housing to the second longitudinal end. Mechanisms having housings of other shapes, including irregular shapes, or housings that are integral with a file or notebook do not depart from the scope of this invention.

The three rings 113 of the ring binder mechanism 101 are substantially similar and are each generally circular in shape (e.g., FIG. 2). The rings 113 are received through openings 177 in the housing 111. As shown in FIGS. 1 and 2, the rings 113 each include two generally semi-circular ring members 123*a*, 123*b* formed from a conventional, cylindrical rod of a suitable material (e.g., steel). The ring members 123*a*, 123*b* include free ends 125*a*, 125*b*, respectively, formed to secure the ring members against transverse misalignment (relative to longitudinal axes of the ring members) when they are closed together (see, FIG. 1). The rings 113 could be D-shaped as is known in the art, or otherwise shaped within the scope of this invention. Ring binder mechanisms with ring members formed of different material or having different cross-sectional shapes, for example, oval shapes, do not depart from the scope of this invention.

Figure 3:
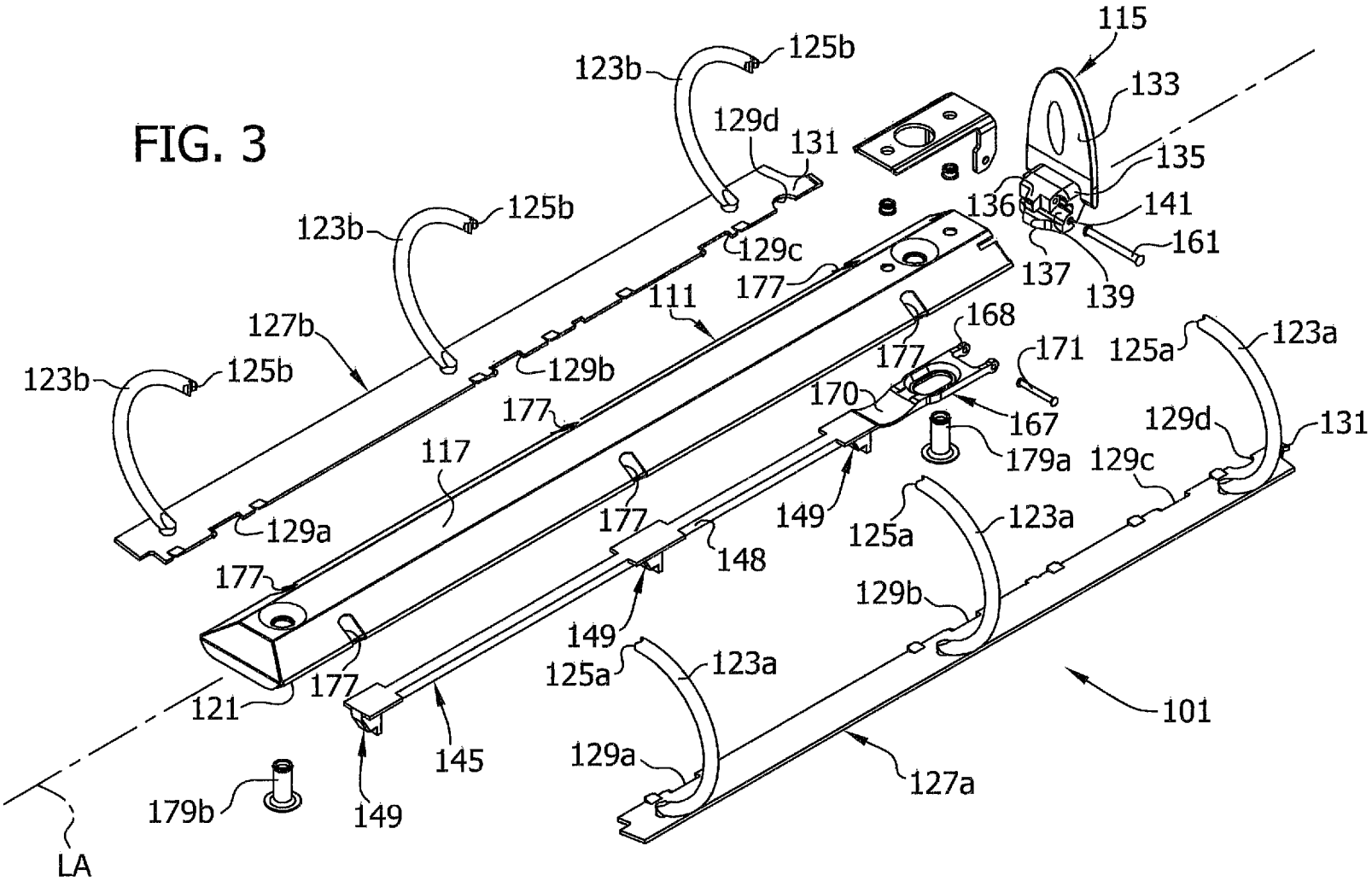
FIG. 3 is an exploded perspective of the ring binder mechanism.
Figure 4:
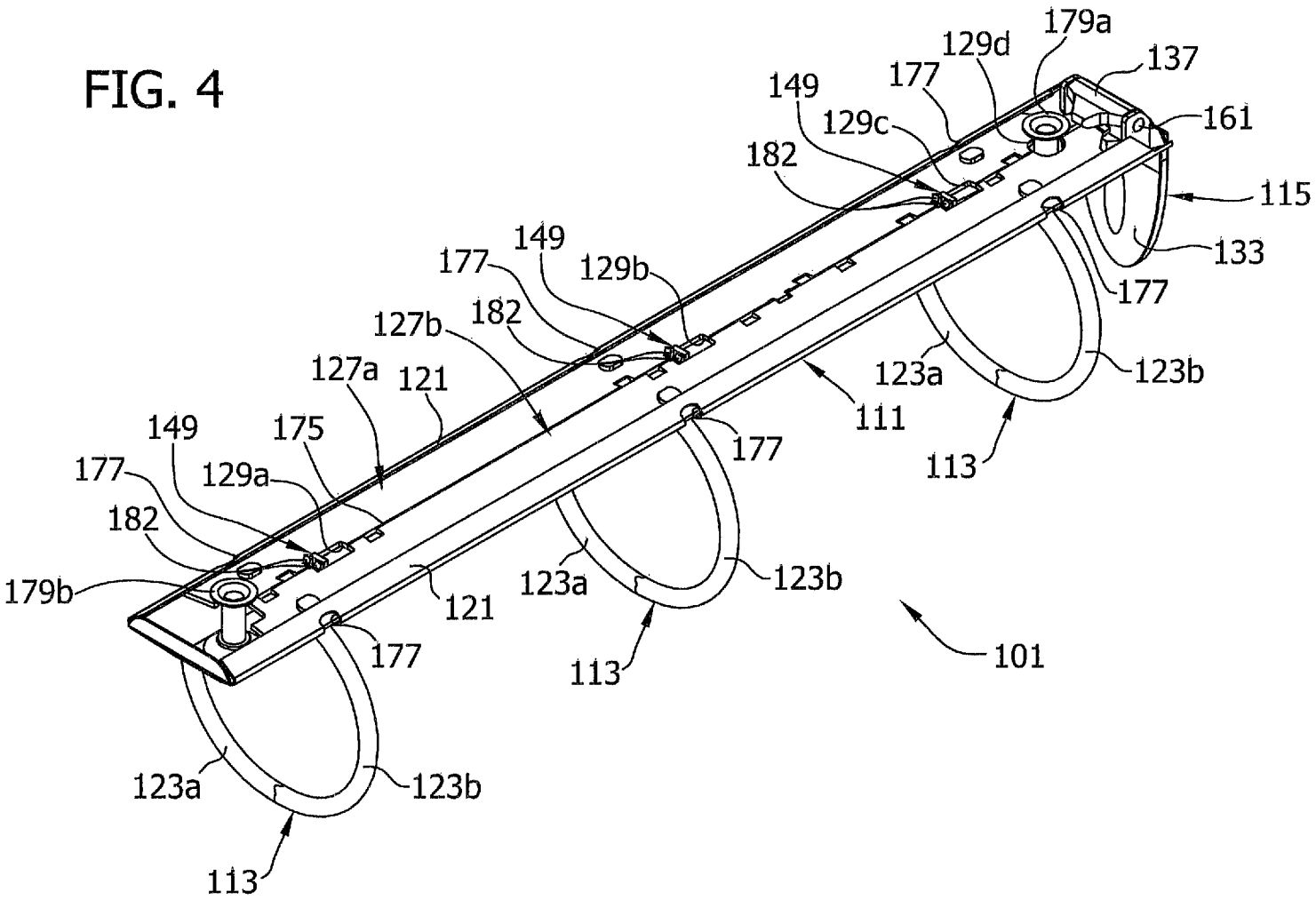
FIG. 4 is a bottom side perspective of the ring binder mechanism.
Figure 5:
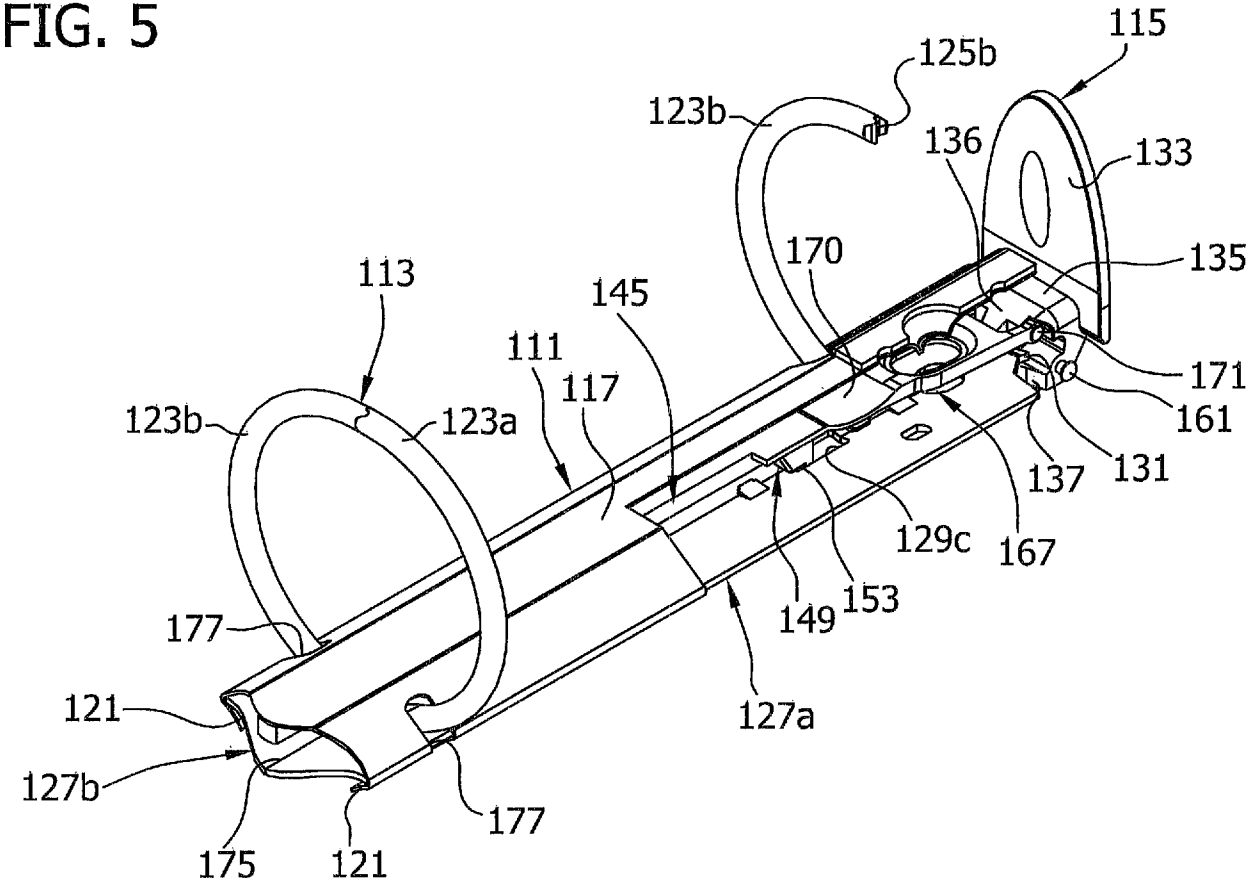
FIG. 5 is an enlarged fragmentary perspective of the ring mechanism of FIG. 2 with a portion of a housing broken away and with a ring member removed to show internal construction.

As also shown in FIG. 3, the ring mechanism 101 includes two substantially identical hinge plates, designated generally at 127*a*, 127*b*, supporting the ring members 123*a*, 123*b*, respectively. The hinge plates 127*a*, 127*b* are each generally elongate, flat, and rectangular in shape and are each somewhat shorter in length than the housing 111. Four corresponding cutouts 129*a-d* are formed in each of the hinge plates 127*a*, 127*b* along an inner edge margin of the plate. A finger 131 extends longitudinally away from a first end of each of the hinge plates 127*a*, 127*b* (to the right in FIG. 3). The fingers 131 are each narrower in width than the respective hinge plates 127*a*, 127*b* and are positioned with their inner longitudinal edges generally aligned with the inner longitudinal edges of the plates. The purpose of the cutouts 129*a-d* and fingers 131 will be described hereinafter. The lever 115 and hinge plates 127*a*, 127*b* can broadly be referred to as an "actuation system."

Referring to FIGS. 2 and 3, the lever 115 includes a grip 133, a body 135 attached to the grip, and an upper lip 136 and lower lip 137 attached to the body. The grip 133 is somewhat broader than each of the body 135, upper lip 136, and lower lip 137 (FIG. 2) and facilitates grasping the lever 115 and applying force to move the lever. In the illustrated ring mechanism 101, the body 135 is formed as one piece with the grip 133 for substantially conjoint movement with the grip. The body 135 may be formed separately from the grip 133 and attached thereto without departing from the scope of the invention.

Figure 6:
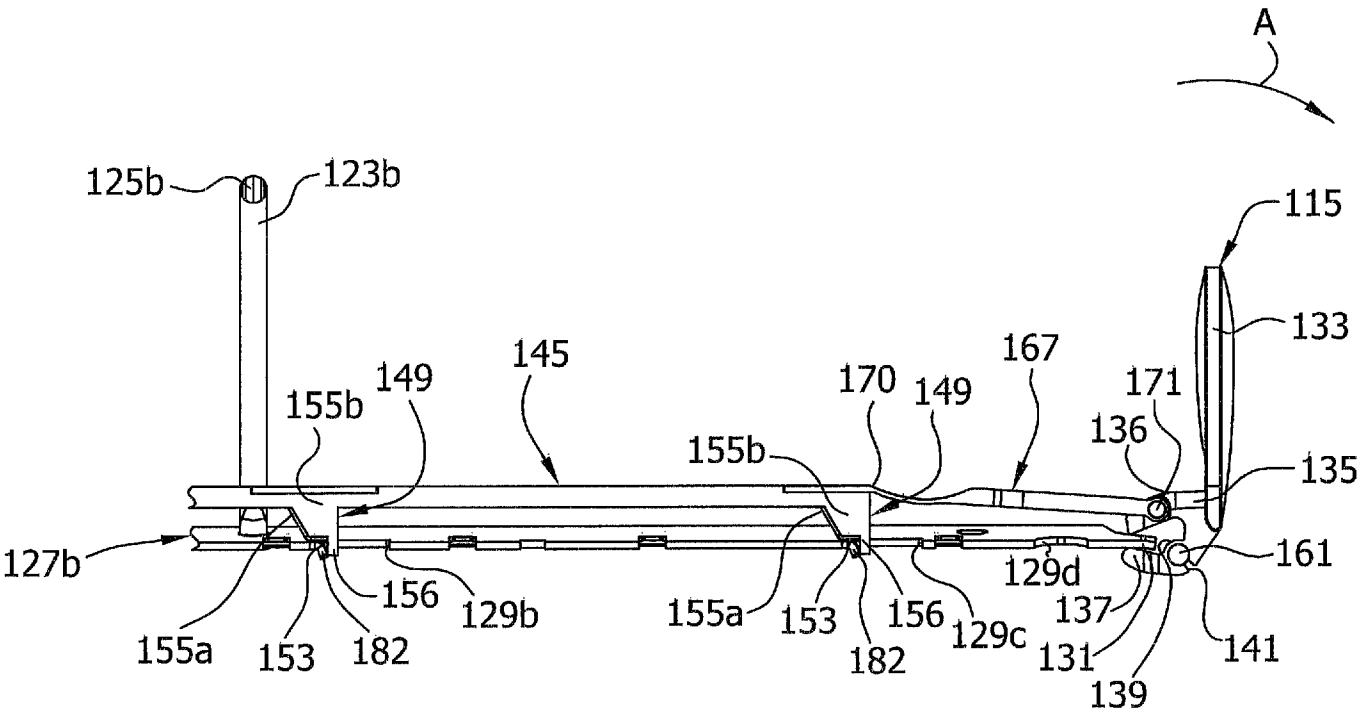
FIG. 6 is a fragmentary side elevation thereof with the housing and a hinge plate removed.
Figure 7:
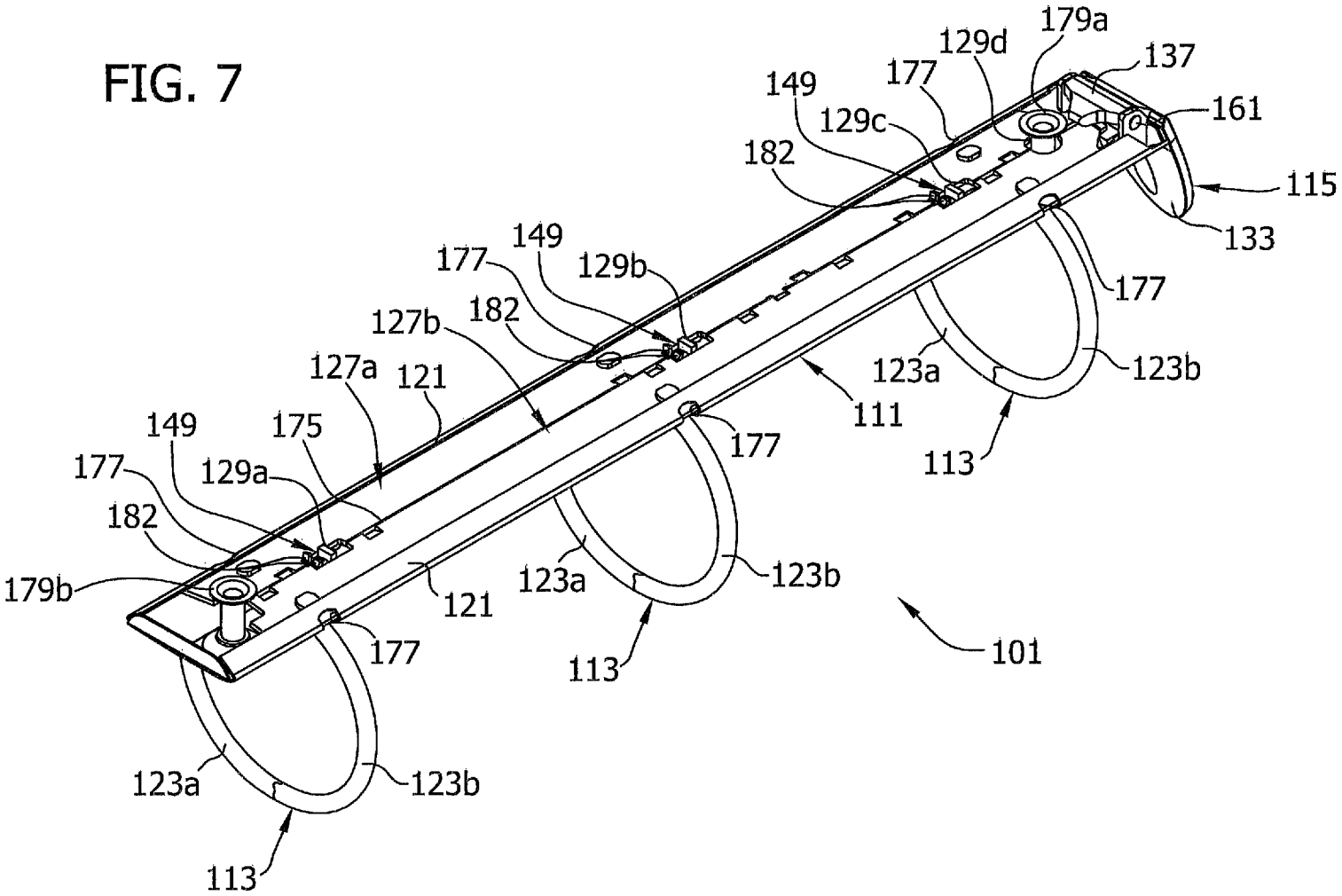
FIG. 7 is similar to FIG. 4 but with the ring mechanism at a closed and unlocked position and with the lever in a first deformed position.

As shown in FIGS. 3 and 6, the lower lip 137 of the lever 115 is attached to the body 135 by a flexible bridge 139 (or "living hinge") formed as one piece with the body and lower lip. A mechanism having a lever in which a bridge is formed separately from a body and/or lower lip for connecting the body and lower lip does not depart from the scope of the invention. The bridge 139 is generally arch-shaped and defines an open channel 141 between the lower lip 137 and body 135. The lower lip 137 extends away from the body 135 at the bridge 139 and channel 141 in general parallel alignment with the upper lip 136 and defines a C-shaped space between the body 135 and lower lip. It is envisioned that the lever 115 is formed from a resilient polymeric material by, for example, a mold process. But the lever 115 may be formed from other materials or other processes within the scope of this invention. A ring mechanism having a lever shaped differently than illustrated and described herein does not depart from the scope of the invention.

Figure 13:
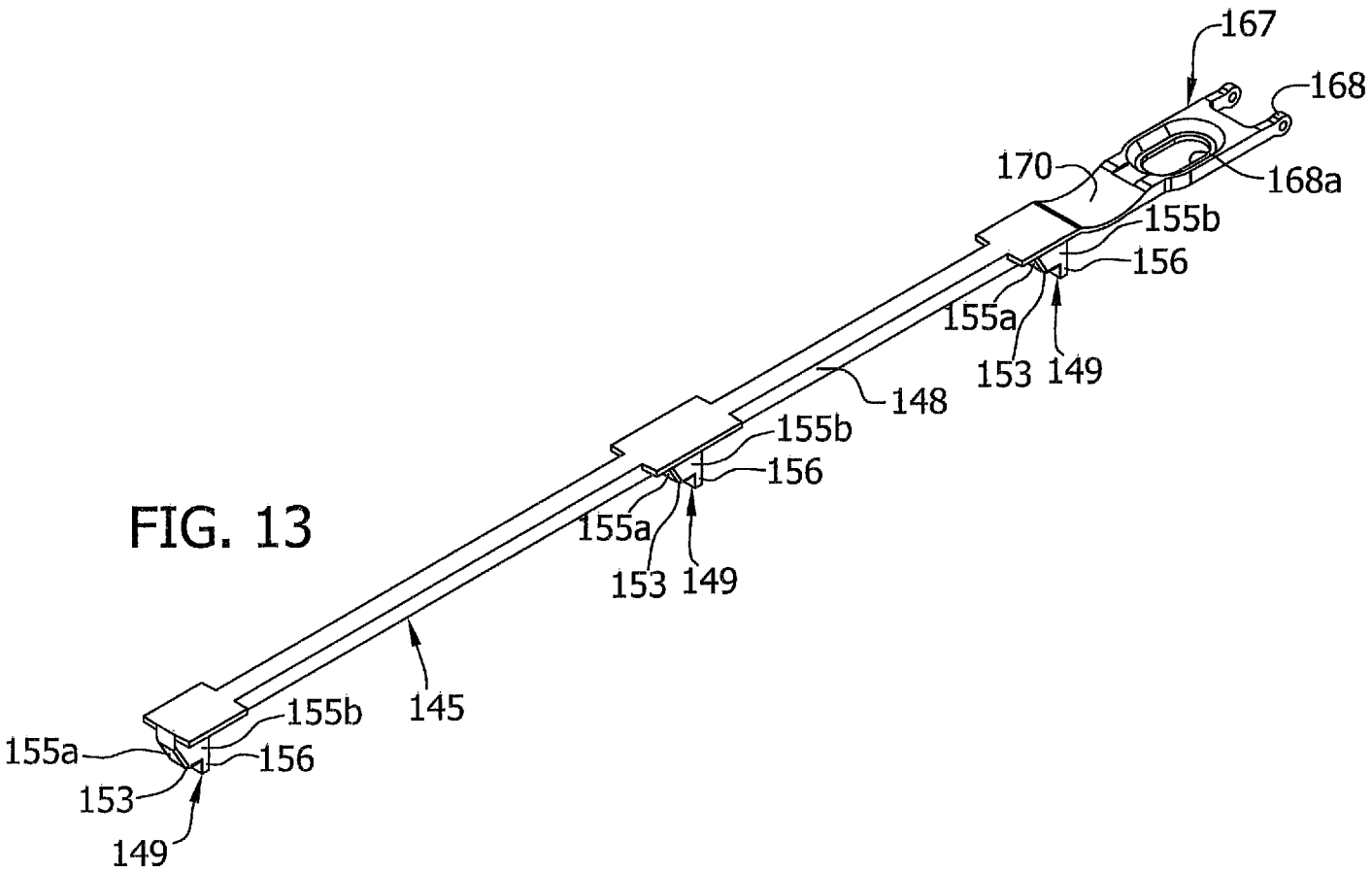
FIG. 13 is a top side perspective of a travel bar.
Figure 14:
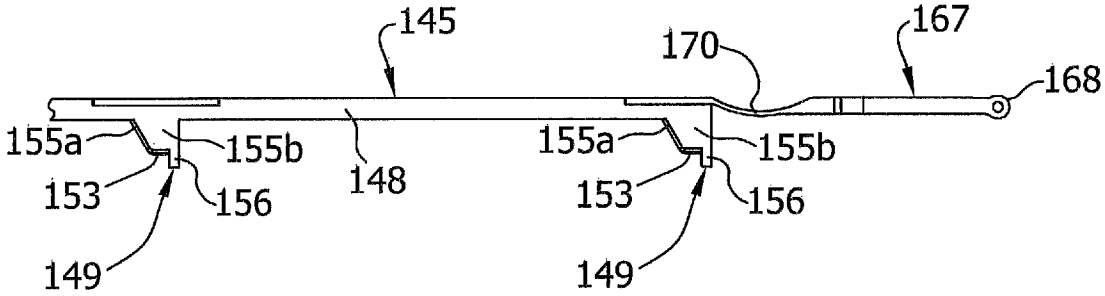
FIG. 14 is a fragmentary side elevation of the travel bar of FIG. 13.
Figure 15:
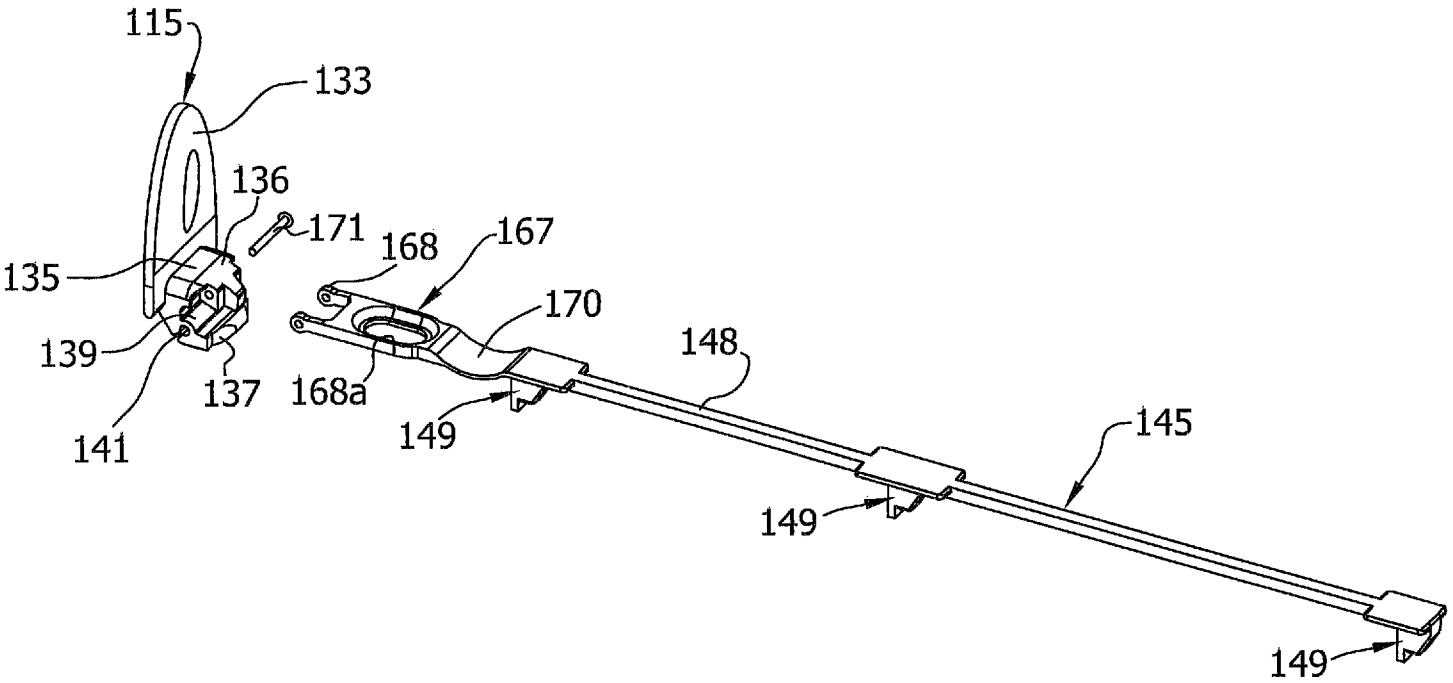
FIG. 15 is a top side perspective showing the lever disconnected from the travel bar.
Figure 16:
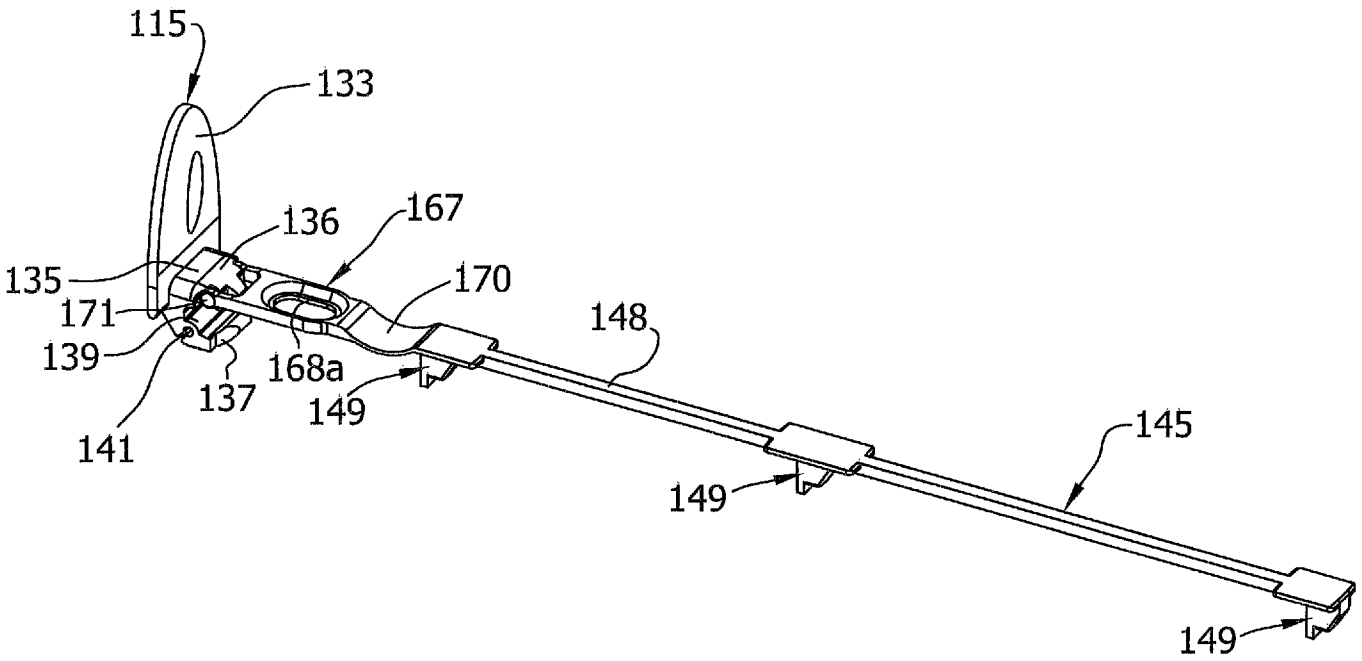
FIG. 16 is a top side perspective similar to FIG. 15 but showing the lever connected to the travel bar.

With reference to FIGS. 3, 13, and 14, the ring mechanism includes a travel bar 145 and an intermediate connector 167 formed as one piece with the travel bar. The travel bar 145 includes an elongate locking portion 148 and three locking elements 149 spaced along a bottom surface of the locking portion. More specifically, one locking element 149 is located adjacent each longitudinal end of the locking portion 148, and one is located toward a center of the locking portion. The elongate locking portion 148 and locking elements 149 may be broadly referred to as a "locking system."

The locking elements 149 of the illustrated locking portion 148 are each substantially similar in shape. As shown in FIGS. 13 and 14, each locking element 149 includes a narrow, flat bottom 153, an angled forward edge 155*a*, recessed lateral sides 155*b* (only one side is visible), and a rearward extension 156. In the illustrated embodiment, the locking elements 149 each have a generally wedge shape. The angled edges 155*a* of the locking elements 149 may engage the hinge plates 127*a*, 127*b* and assist in pivoting the hinge plates down. In the illustrated embodiment, the locking elements 149 are formed as one piece of material with the travel bar 145 by, for example, a mold process. But the locking elements 149 may be formed separately from the travel bar 145 and attached thereto without departing from the scope of the invention. Additionally, locking elements with different shapes, for example, block shapes (e.g., no angled edges or recessed sides), are within the scope of this invention.

The intermediate connector 167 of the ring mechanism 101 includes a connector portion 168 at one end of the travel bar 145, and a flexible hinge 170 between the locking portion 148 and the connector portion 168. The connector portion 168 is formed with an elongate opening 168*a* for receiving a mounting post 179*a*, 179*b* through the opening and allowing the travel bar 145 to move lengthwise of a housing 111 relative to the mounting post during operation of the mechanism 101. The connector portion 168 connects to the lever 115 at an upper lip 136 of the lever by a mounting pin 171 so that pivoting movement of the lever produces translational movement of the travel bar 145. The flexible hinge 170 of the travel bar 145 is thin and has a generally flat "U" shape when relaxed. The flexible hinge 170 is capable of flexing, or bowing, to a more pronounced "U" shape to allow the connector portion 168 of the travel bar 145 to move relative to and toward the locking elements 149.

FIGS. 2 and 4-7 illustrate ring members 123*a*, 123*b* of the ring mechanism 101 in a closed and locked position. The locking elements 149 of the locking portion 148 are positioned adjacent respective cutouts 129*a-d* and above the hinge plates 127*a*, 127*b* generally aligned with the hinge 175. The locking elements 149 are substantially out of registration with the cutouts 129*a-d*. The flat bottom surfaces 153 rest on an upper surface of the plates 127*a*, 127*b* and the rearward extensions 156 extend through each respective cutouts 129*a-d* adjacent forward, downturned tabs 182 of the plates. Together, the locking portion 148 and locking elements 149 oppose any force tending to pivot the hinge plates 127*a*, 127*b* upward to open the ring members 123*a*, 123*b* (i.e., they lock the ring members closed).

Figure 8:
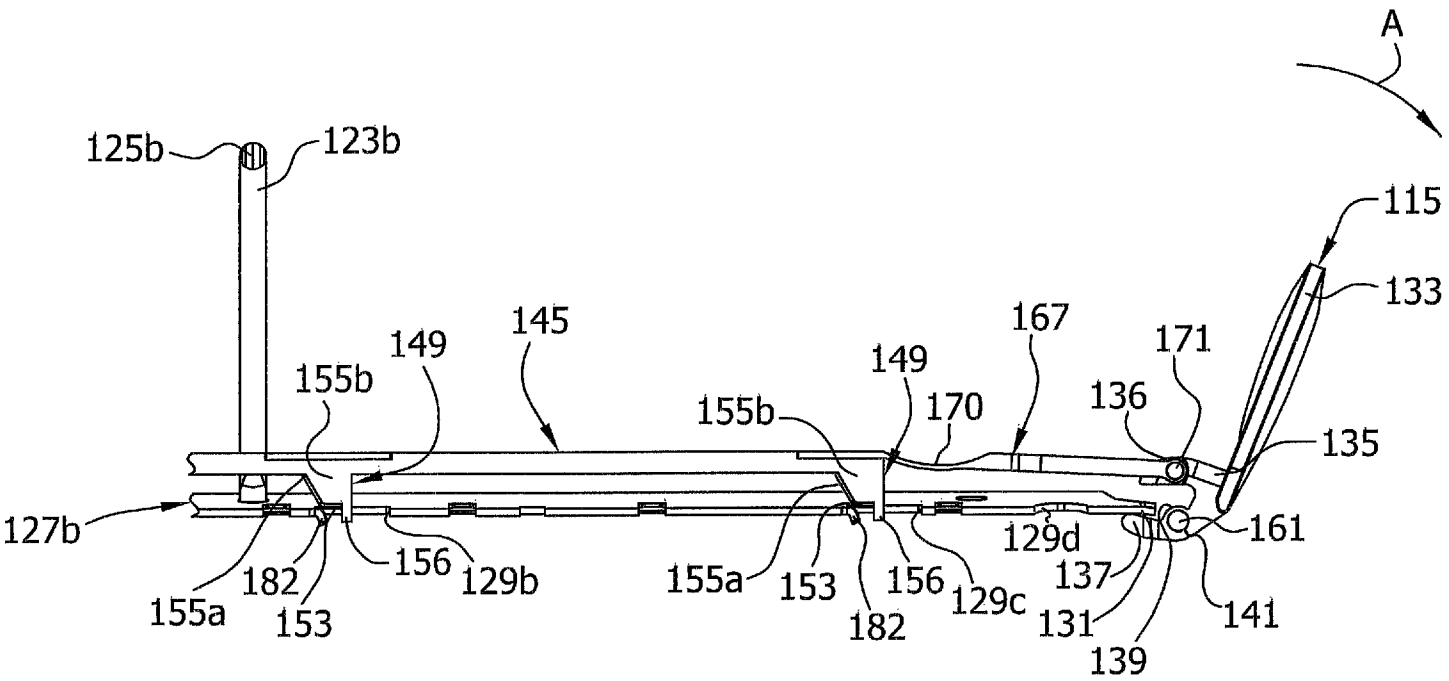
FIG. 8 is similar to FIG. 6 but with the ring mechanism at the closed and unlocked position and the lever at the first deformed position.
Figure 9:
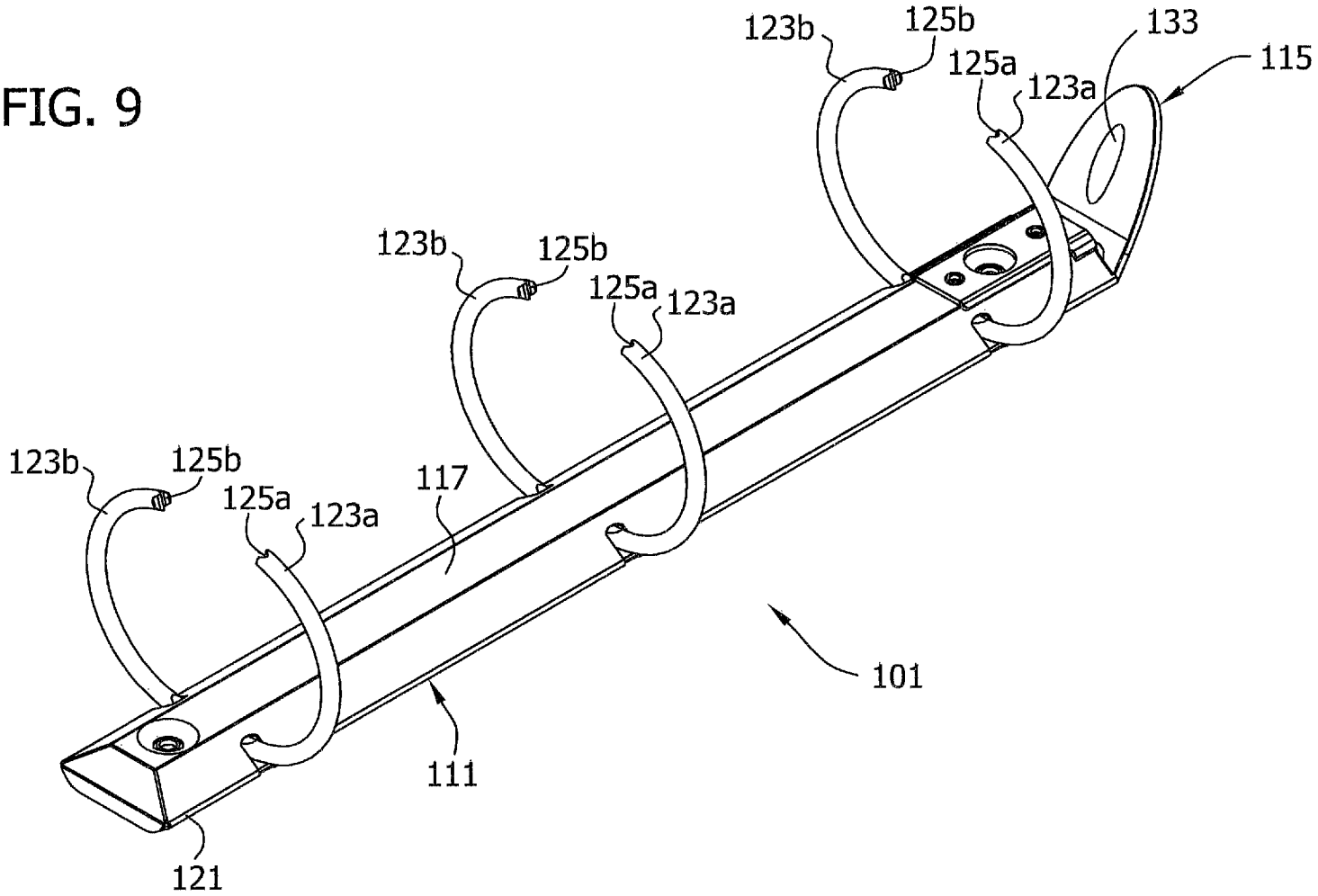
FIG. 9 is a top side perspective of the ring mechanism at an open position.
Figure 10:
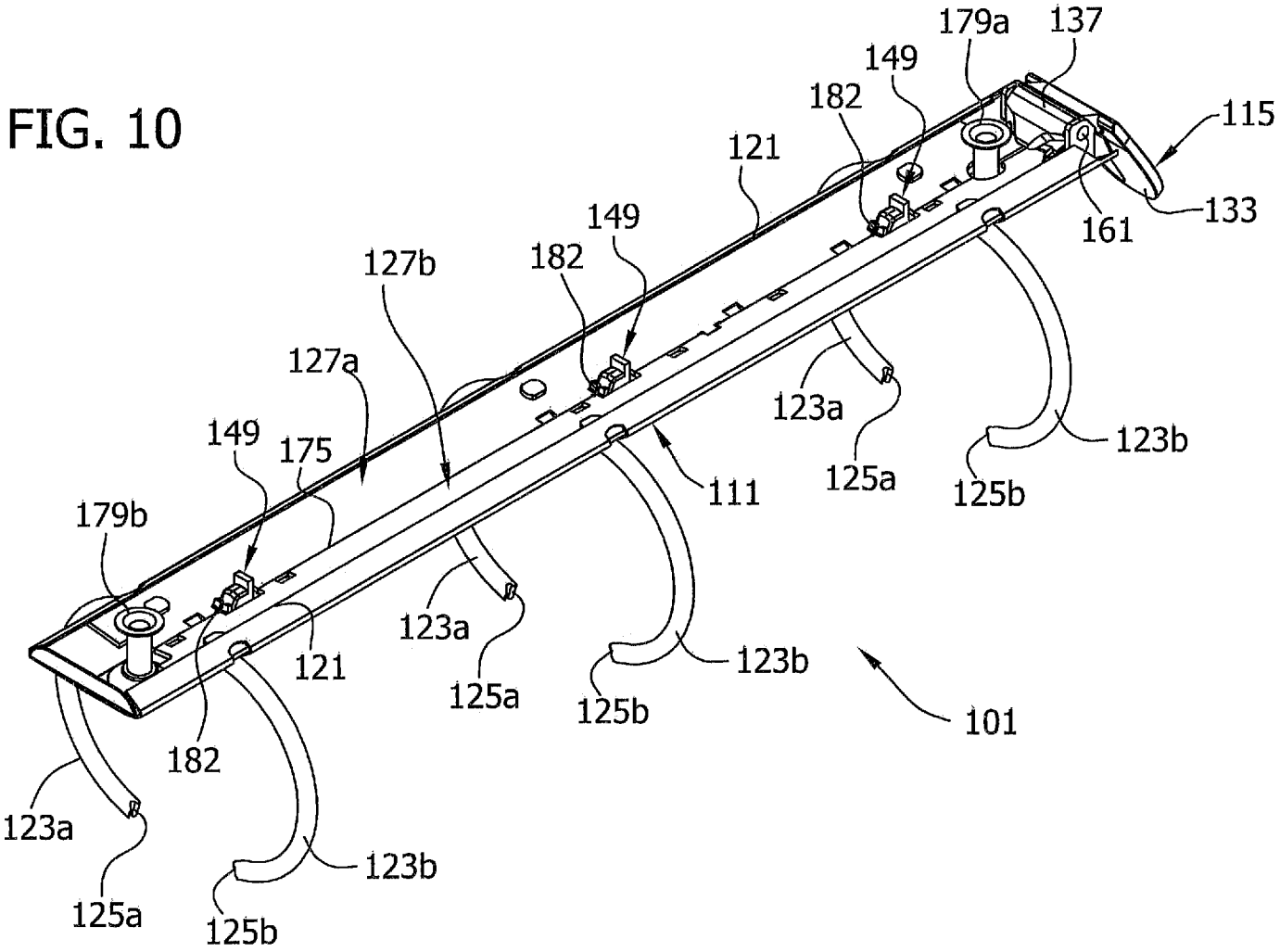
FIG. 10 is a bottom side perspective thereof.
Figure 11:
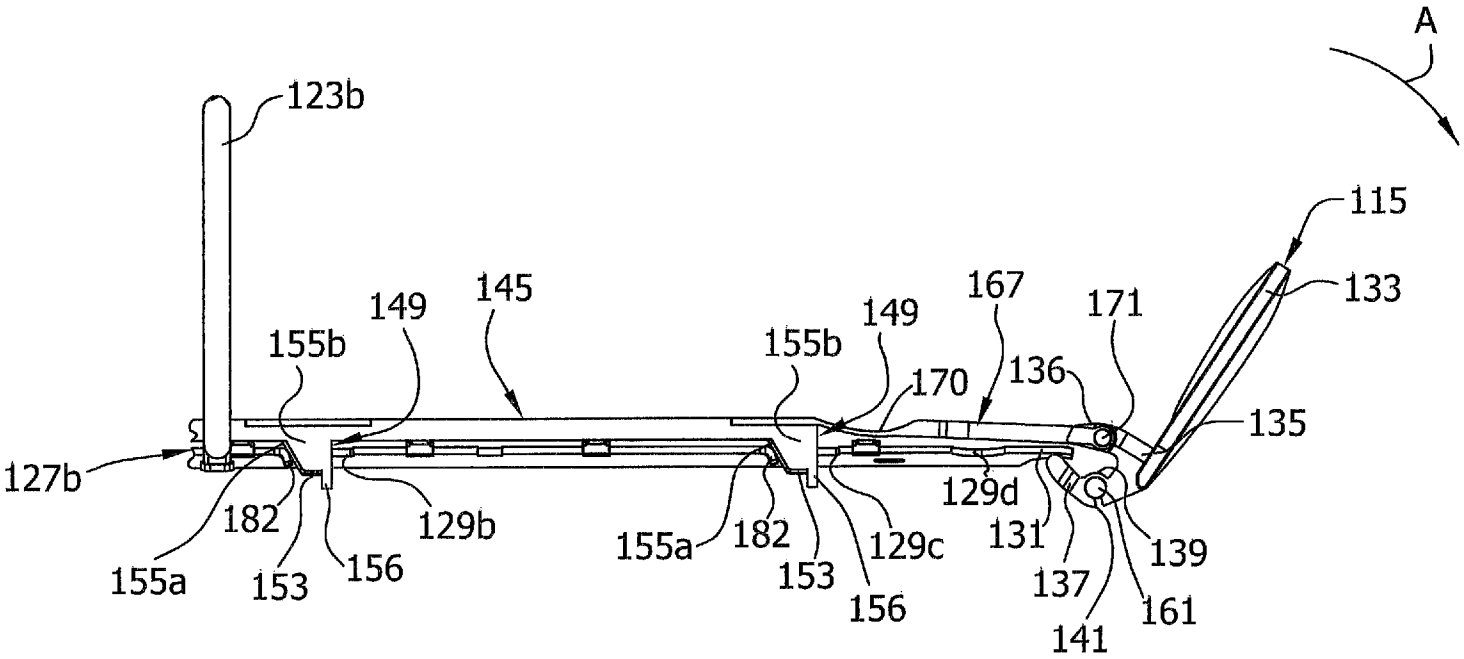
FIG. 11 is similar to FIG. 6 but with the ring mechanism at the open position and with the lever in a second deformed position.

To open the ring members 123*a*, 123*b*, the lever 115 pivots outward and downward (in a clockwise direction as indicated by the arrow in FIG. 6). As shown in FIG. 8, the lower lip 137 engages bottom surfaces of hinge plates 127*a*, 127*b* and the upper lip 136 pulls the travel bar 145 and thereby locking elements 149 toward an unlocked position. The lever 115 is formed to pull the locking elements 149 from the locked position before pivoting the hinge plates 127*a*, 127*b* to open ring members 123*a*, 123*b*. More specifically, the locking elements 149 are moved into registration over the respective cutouts 129*a-d* of the hinge plates 127*a*, 127*b* before the plates pivot. The flexible hinge 170 may slightly elongate under the pulling tension from the upper lip 136, but for the most part it substantially retains its generally shallow "U" shape. The flexible bridge 139 between a body 135 of the lever 115 and the lower lip 137 of the lever flexes and tensions. The open channel 141 between the body 135 and lower lip 137 closes and the body moves into engagement with the lower lip. Continued opening movement of the lever 115 causes the body 135 to conjointly pivot the lower lip 137, pushing the hinge plates 127*a*, 127*b* upward through the co-planar position. This moves the ring members 123*a*, 123*b* to an open position as shown in FIGS. 9-11.

Figure 12A:
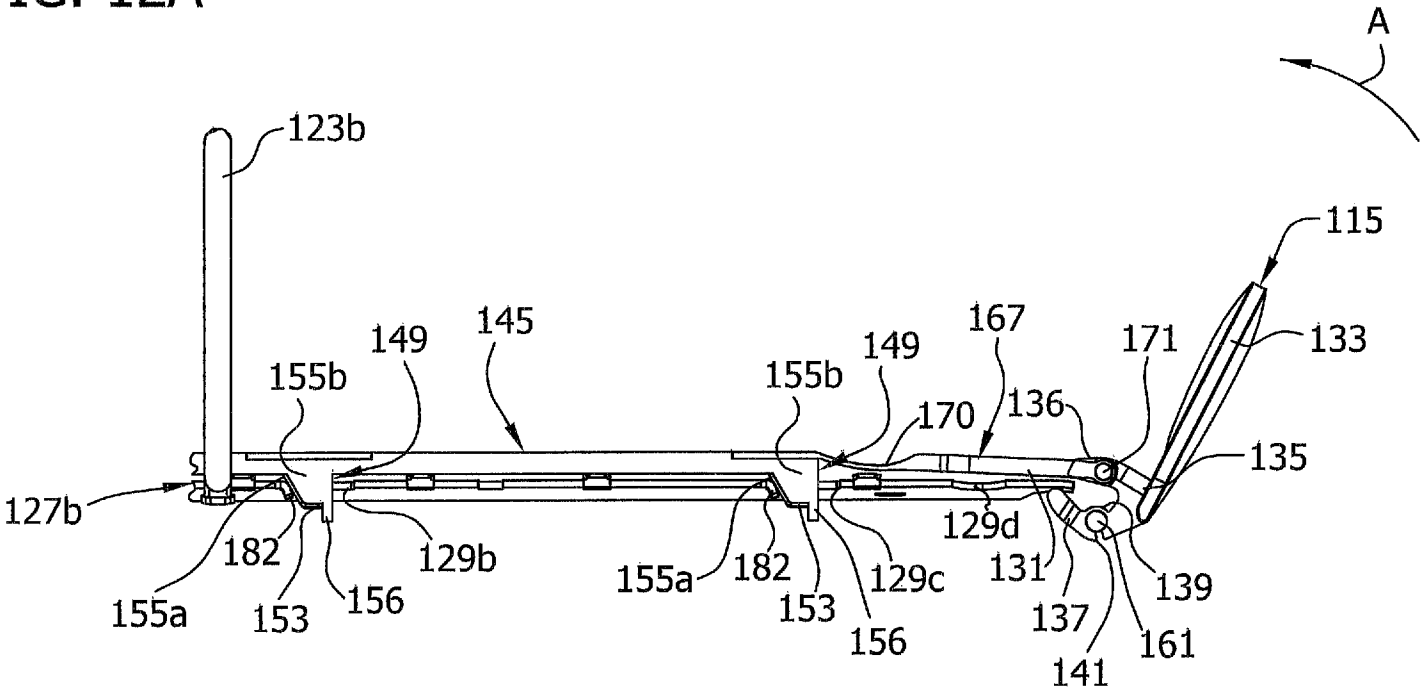
FIGS. 12A and 12B are side views similar to FIG. 11 illustrating pivoting movement of the lever toward the closed and locked position and the concurrent deformation of a hinge of the intermediate connector.

To close the ring members 123*a*, 123*b* and return the mechanism 101 to the locked position, an operator can pivot the lever 115 upward and inward. As shown in FIG. 12A, this moves the upper lip 136 of the lever 115 into contact with the upper surfaces of the hinge plates 127*a*, 127*b* (if it is not already in contact with the hinge plate upper surfaces). The upper lip 136 engages the upper surfaces of the hinge plates 127*a*, 127*b* and begins pushing them downward, but the spring force of the housing 111 resists the initial hinge plate movement. The travel bar 145 may initially move forward with the movement of the upper lip 136 to seat forward edges 155*a* of the locking elements 149 against tabs 182 of the hinge plates 127*a*, 127*b* (if the locking elements are not already seated). As the lever 115 continues to pivot, the seated locking elements 149 resist further movement of the travel bar 145. As shown in FIG. 12A, the flexible hinge 170 of the travel bar 145 begins to bow (or deflect downward to a more pronounced "U" shape) to allow the lever 115 to continue to pivot. This relative movement between the connector portion 168 of the intermediate connector 167 and the locking elements 149 causes tension in the flexible hinge 170. At this instant in the closing movement, if the lever 115 is released before the hinge plates 127*a*, 127*b* pivot downward through their co-planar position (i.e., before the ring members 123*a*, 123*b* close), the tension in the flexible hinge 170 will automatically recoil (and push) the lever back to its starting position.

Figure 12B:
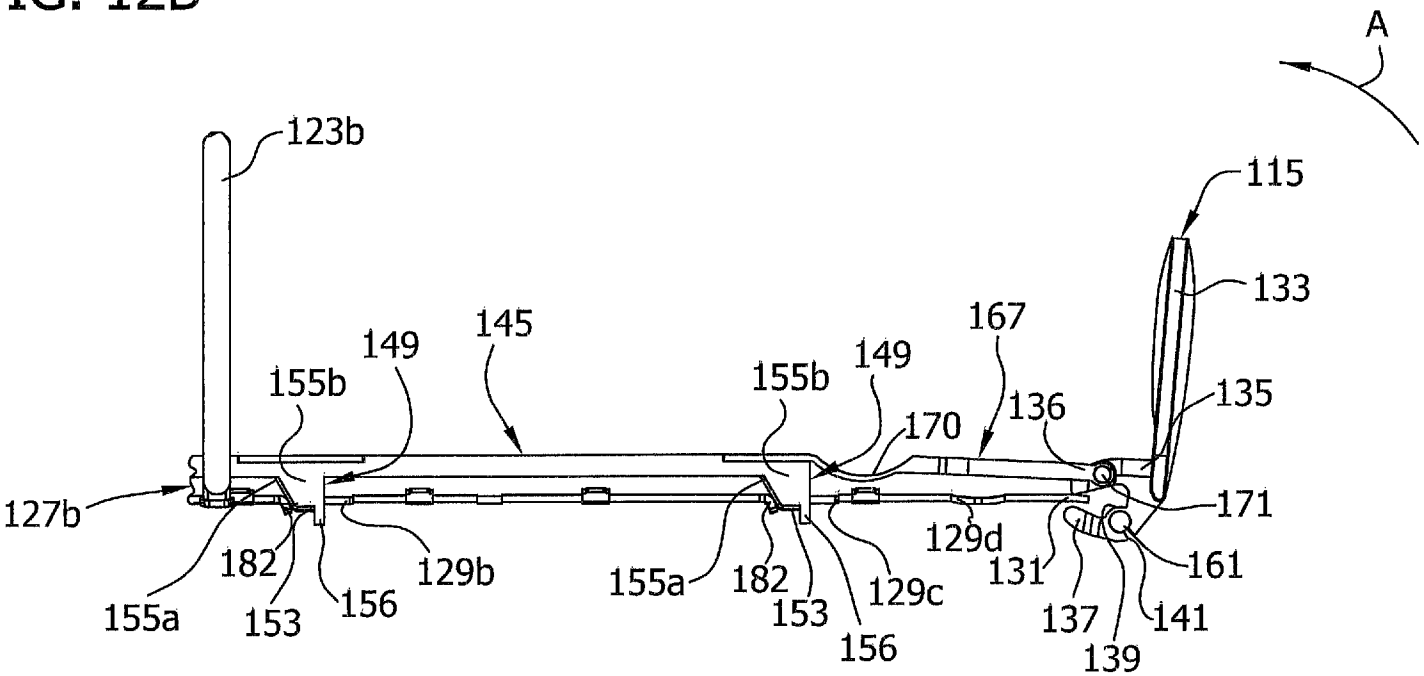

As shown in FIG. 12B, continued closing movement of the lever 115 causes the upper lip 136 to pivot the interconnected hinge plates 127*a*, 127*b* downward. Once the hinge plates 127*a*, 127*b* pass just through the co-planar position, the housing's spring force pushes them downward, closing the ring members 123*a*, 123*b*. As the hinge plates 127*a*, 127*b* pivot downward, the angled forward edges 155*a* of the locking elements 149 allow the locking elements and travel bar 145 to move to the left (as viewed in FIG. 12B). The flexible hinge 170 remains deformed and tensioned during this initial movement. Once the hinge plates 127*a*, 127*b* clear the angled forward edges 155*a* of the locking elements 149, they no longer operate to resist forward movement of the locking elements and travel bar 145. The locking elements 149 now move conjointly with the lever 115 to their locked position behind the hinge plates 127*a*, 127*b*. At the same time, the bridge 139 flattens and the tension in the flexible hinge 170 recoils and further pushes the locking elements 149 to the locked position. The bridge 139 and flexible hinge 170 return to their relaxed positions. The mechanism 101 is again in the position shown in FIG. 6.

In this ring mechanism 101, the flexible hinge 170 of the intermediate connector 167 allows the lever 115 to pivot to move the hinge plates 127*a*, 127*b* downward to close the ring members 123*a*, 123*b* before pushing the locking elements 149 to the locked position behind the hinge plates. It also provides a flexible connection between the connector portion 168 and locking portion 148. The flexible hinge 170 receives slight vertical movement from the lever 115 (through the connector portion 168) when the lever pivots and shields the locking portion 148 from the vertical movement so that the locking elements 149 remain stationary (vertically) during operation.

Figure 17:
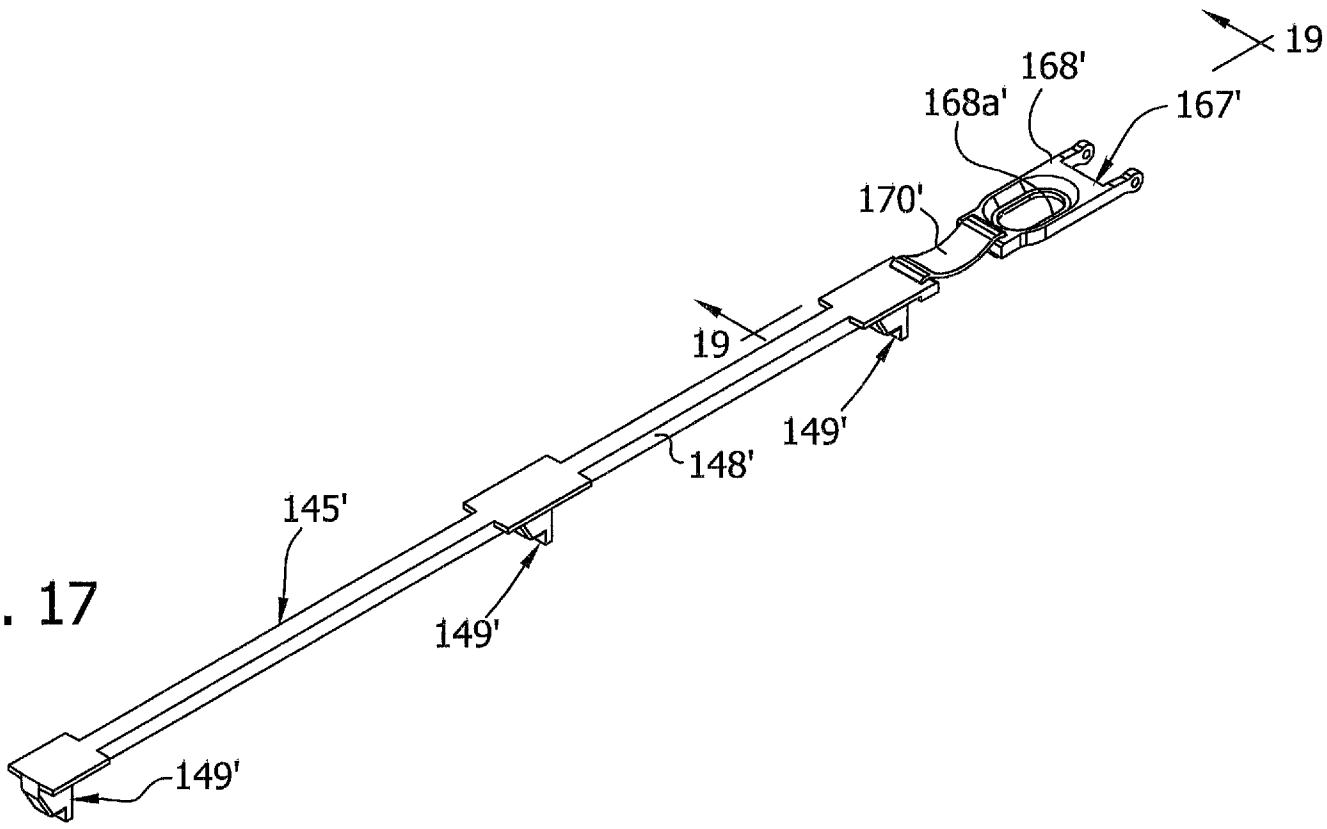
FIG. 17 is a top side perspective of a travel bar having another configuration.
Figure 18:
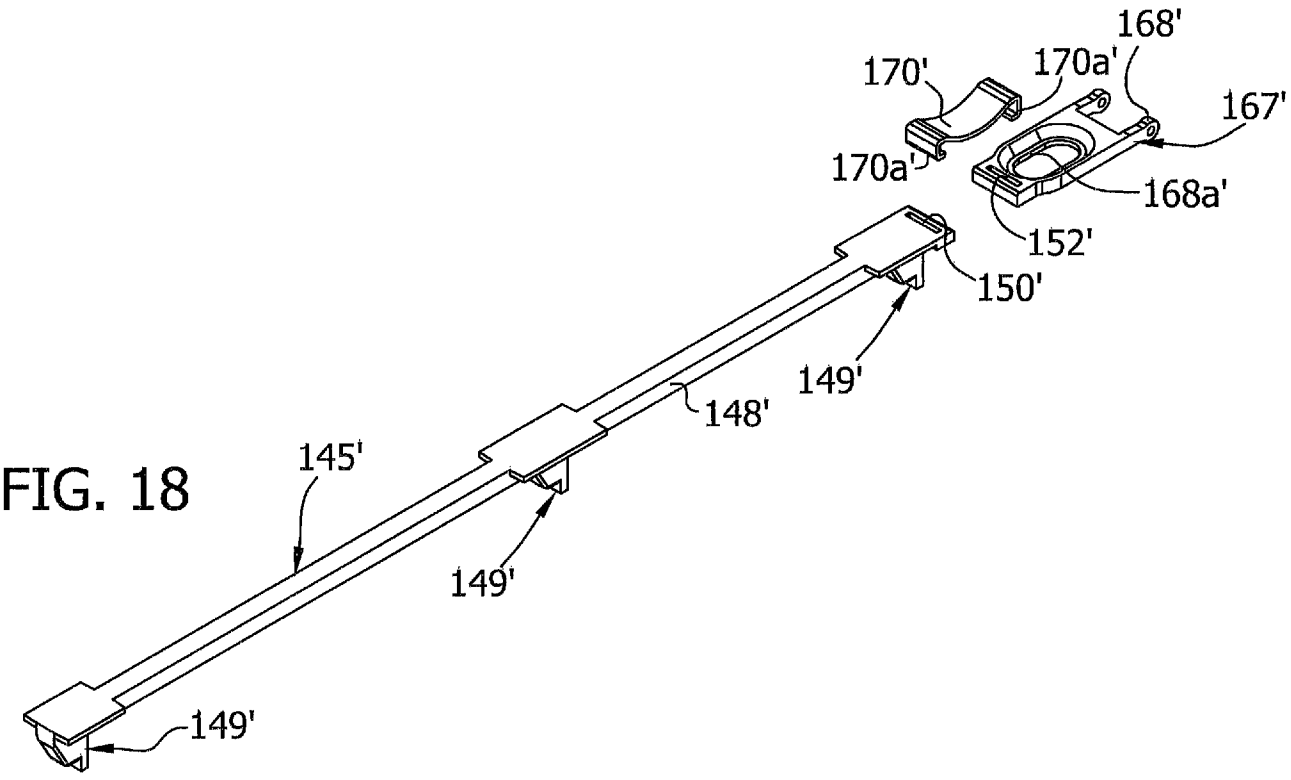
FIG. 18 is an exploded perspective thereof.
Figure 19:
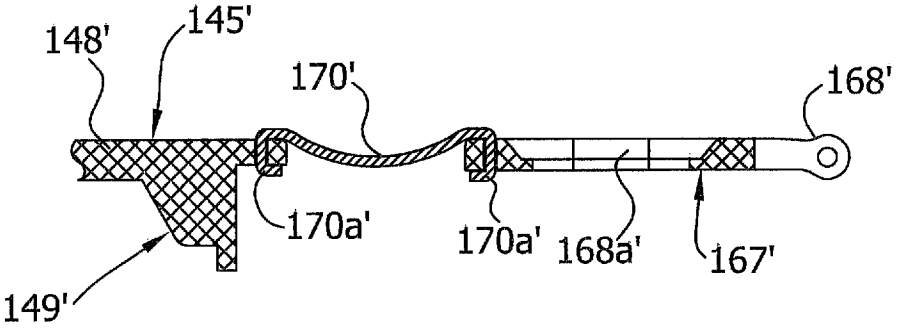
FIG. 19 is a fragmentary cross section taken along line 19-19 of FIG. 17.
Figure 20:
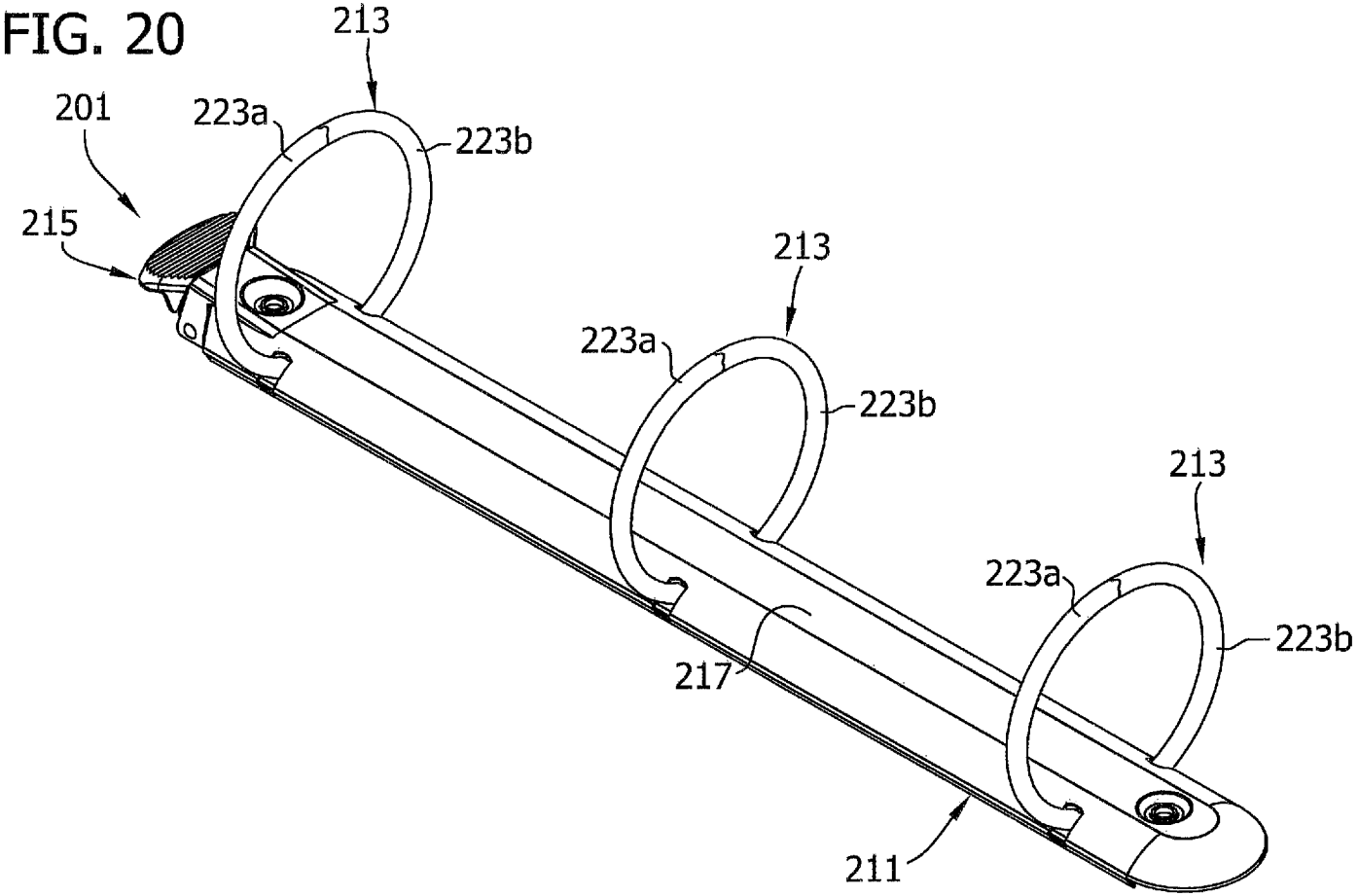
FIG. 20 is a top side perspective of another embodiment of a ring binder mechanism at a closed and locked position and with the lever in a first relaxed position.
Figure 21:
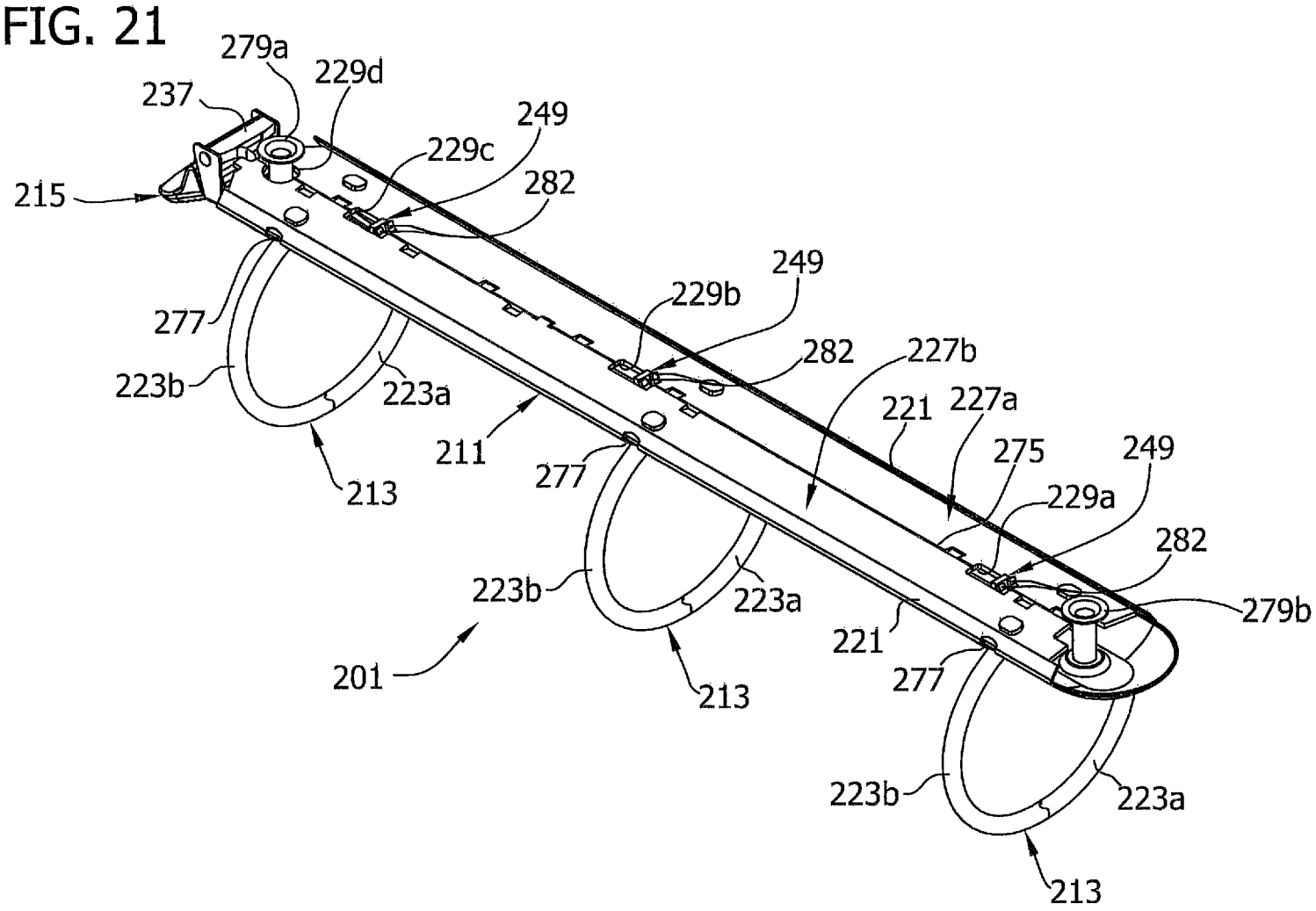
FIG. 21 is a bottom side perspective of the ring mechanism.

In the embodiment of FIGS. 1-16, the illustrated flexible hinge 170 of the intermediate connector 167 is formed as one piece with the locking portion 148 and the connector portion 168 of the travel bar 145 generally between the locking portion and the connector portion. However, as shown in FIGS. 17-19, a flexible hinge 170' may be formed as a separate piece from a locking portion 148' of the travel bar 145' and a connector portion 168' of a intermediate connector 167' and connected thereto. The flexible hinge 170' is formed with hook-shaped ends 170*a'* that are received in openings 150', 152' in the locking portion 148' and in the connector portion 168', respectively. The flexible hinge 170' may be connected to the locking portion 148' and connector portion 168' differently within the scope of the invention. In operation, the flexible hinge 170' of FIGS. 17-19 is bowed similarly to the flexible hinge 170 of FIGS. 1-16.

It is understood that a flexible hinge may be shaped differently than illustrated herein and still be within the scope of the invention. For example, the flexible hinge may be resiliently collapsible in accordion fashion to accommodate the longitudinal movement of the connector portion relative to the locking portion.

It is contemplated that each part of the travel bar an intermediate connector is made from a plastic material, but they may be made from another suitable material such as a metal. In addition, different parts of the travel bar may be formed from different materials, but it is to be understood that the flexible hinge is formed from spring steel, plastic, or other flexible material.

FIGS. 20-32 illustrate a ring binder mechanism 201 according to yet another embodiment. The mechanism 201 is similar to the mechanism 101 previously described and illustrated in FIGS. 1-19, but does not include a U-shaped hinge 170. Parts of the ring mechanism 201 corresponding to parts of the ring mechanism 101 of FIGS. 1-16 are designated by the same reference numerals, plus "100". For example, the ring mechanism 201 includes an actuating lever 215 having a grip 233 and mounted for pivoting movement relative to the housing via a pin 261 received in an opening 260 in a housing 211 having a central plateau 217 and bent under rims 221 extending lengthwise along longitudinal edges of the housing. Ring members 223*a*, 223*b* are mounted on hinge plates 227*a*, 227*b*, having longitudinally extending fingers 231 at one end, as described above. The hinge plates 227*a*, 227*b* have cutouts 229*a-d* corresponding to cutouts 129*a-d* described above. The ring members 223*a*, 223*b* extend through openings 277 in the side of the housing 211 and have free ends 225*a*, 225*b* formed to secure the ring members against transverse misalignment when they are closed together. The mechanism also has mounting posts 279*a*, 279*b* that are analogous to the mounting posts 179*a*, 179*b* described above. In this embodiment, an intermediate connector 267 is formed as one piece with the travel bar 245, but is connected by a living hinge 272 that permits pivoting of the intermediate connector relative to the travel bar but does not deform lengthwise as does the U-shaped flexible hinge 170, 170' of FIGS. 1-19. Thus, in this mechanism 201, the living hinge 272 converts the pivoting motion of a lever 215 to translational movement of the travel bar 245, but does not allow a lever 215 to pivot to close hinge plates 227*a*, 227*b* before moving a travel bar 245 and locking elements 249 to a locked position. To close the ring members 223*a*, 223*b*, they can be manually pushed together.

Figure 22:
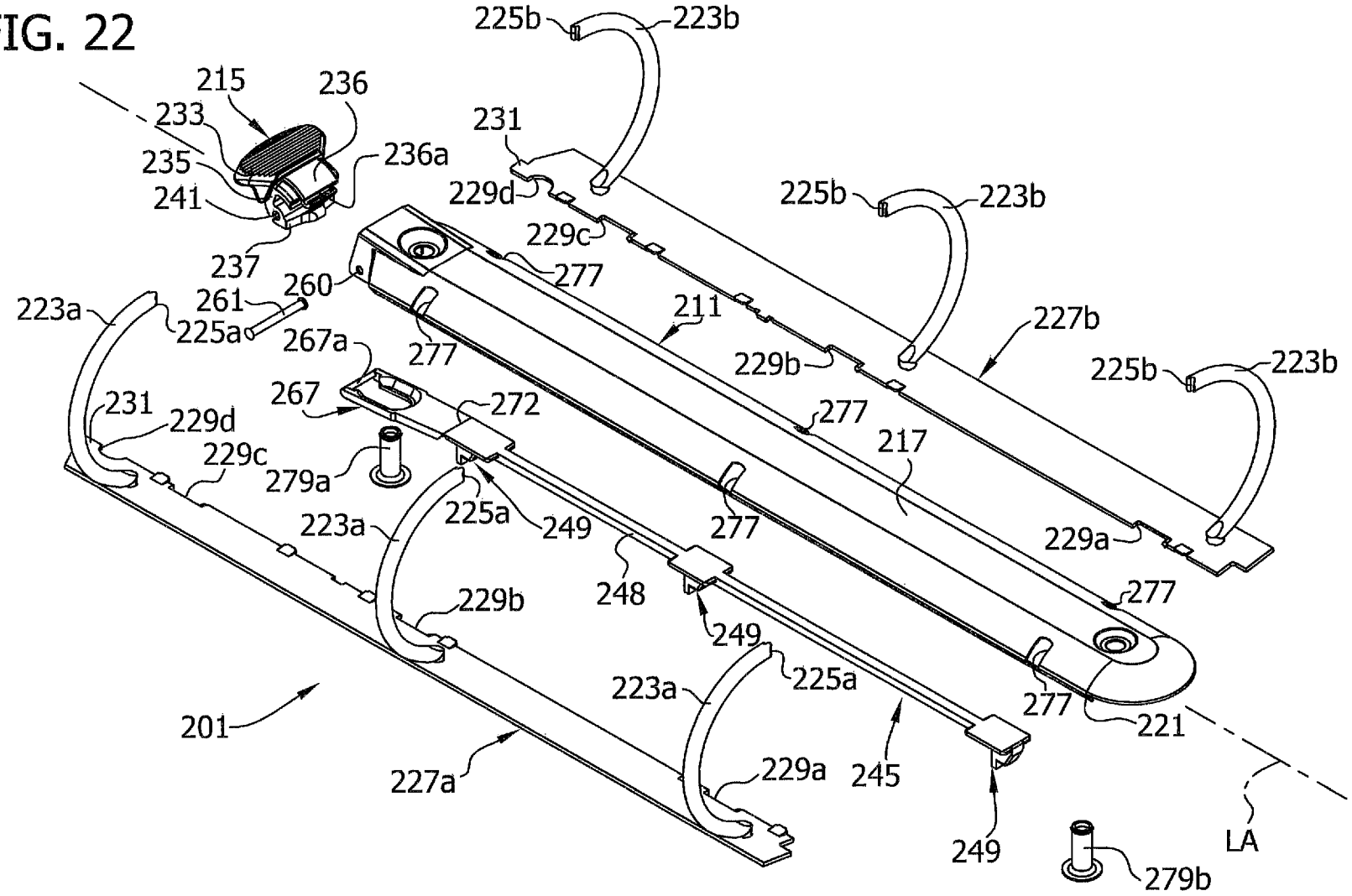
FIG. 22 is an exploded perspective of the ring binder mechanism.
Figure 23:
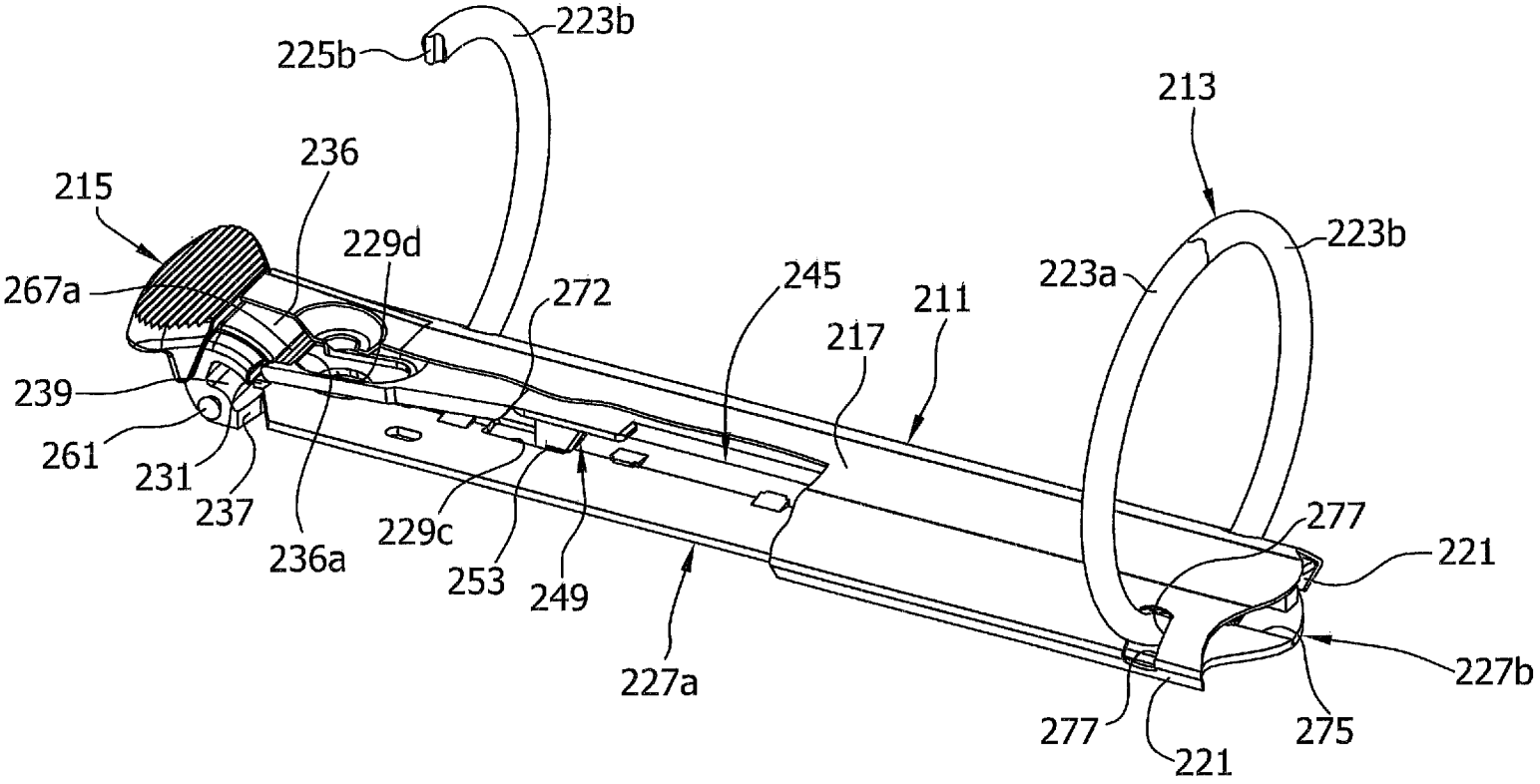
FIG. 23 is an enlarged fragmentary perspective of the ring mechanism of FIG. 20 with a portion of a housing broken away and with a ring member removed to show internal construction.
Figure 24:
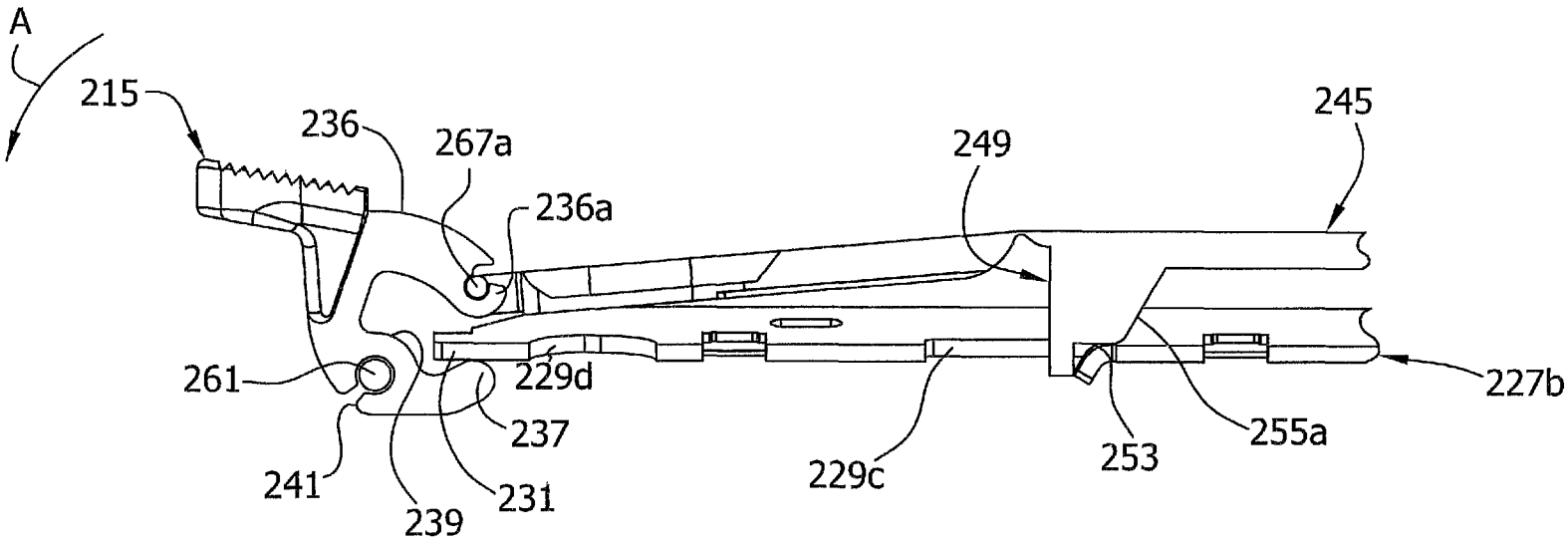
FIG. 24 is an enlarged fragmentary side elevation of the ring mechanism with the housing and a hinge plate removed.
Figure 25:
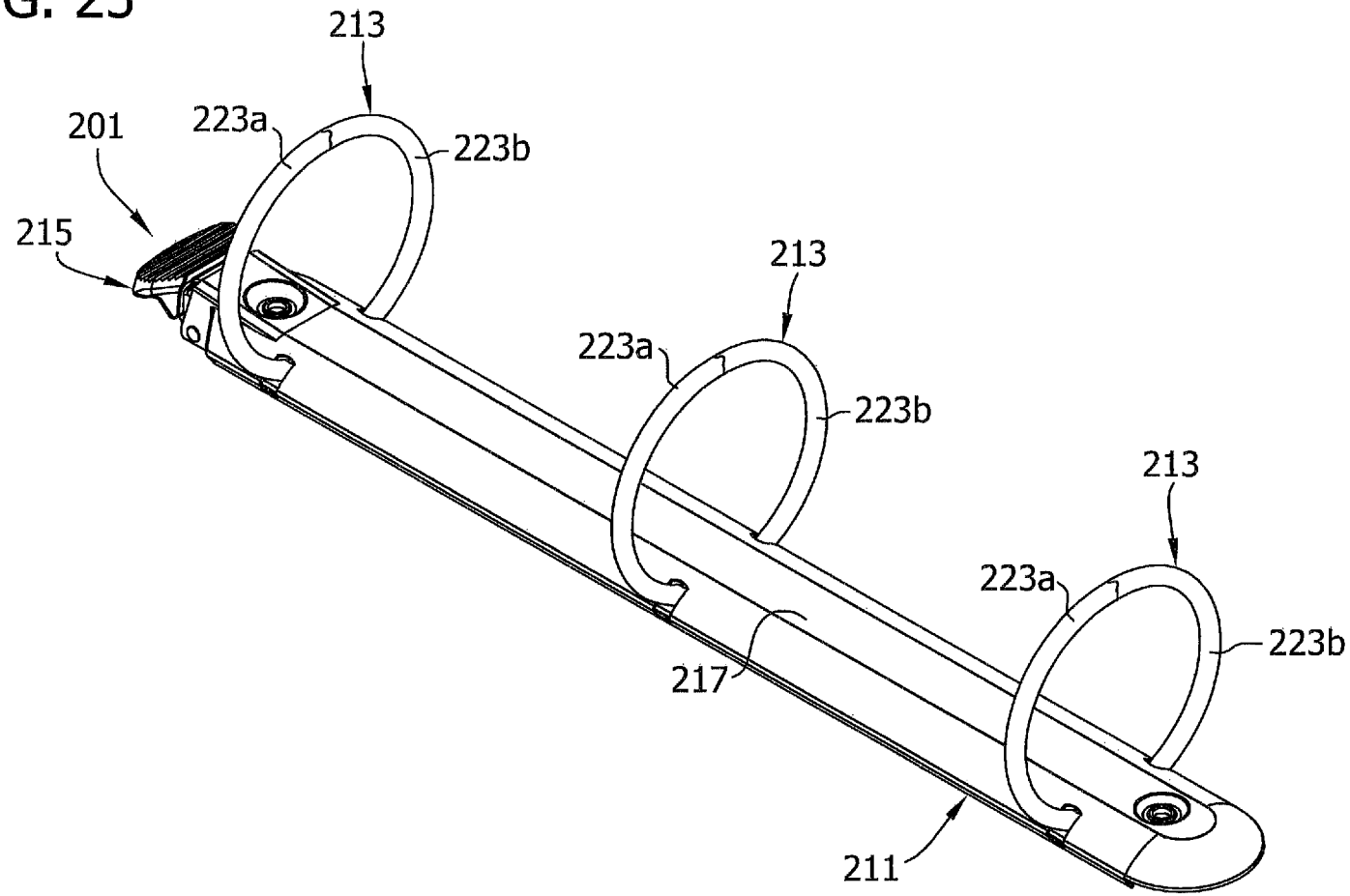
FIG. 25 is similar to FIG. 20 but with the ring mechanism at a closed and unlocked position and with the lever in a first deformed position.
Figure 26:
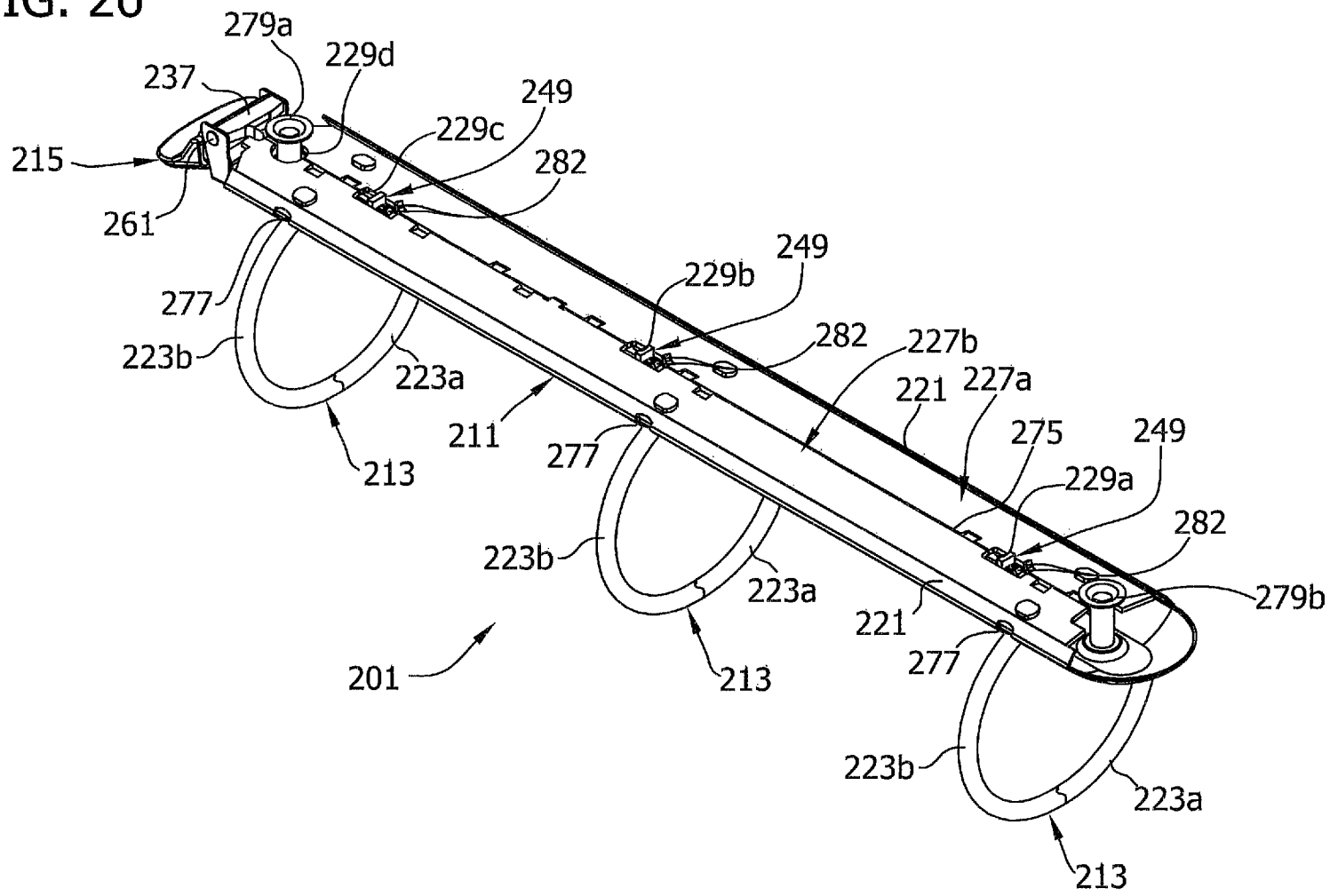
FIG. 26 is a bottom side perspective thereof.
Figure 31:
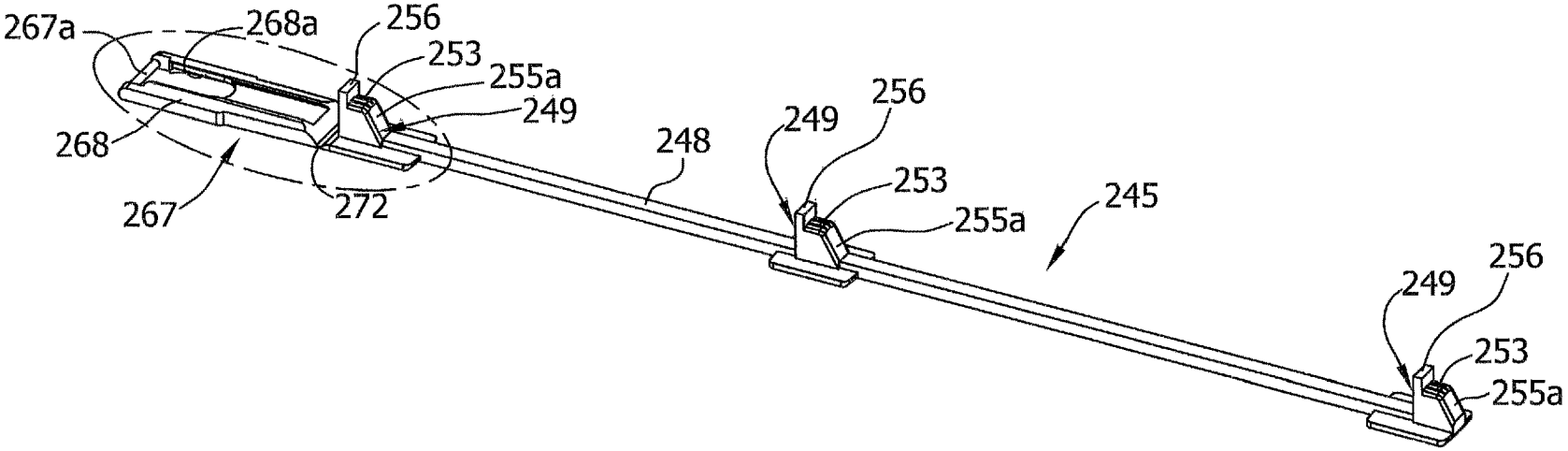
FIG. 31 is bottom side perspective of a travel bar.
Figure 32:
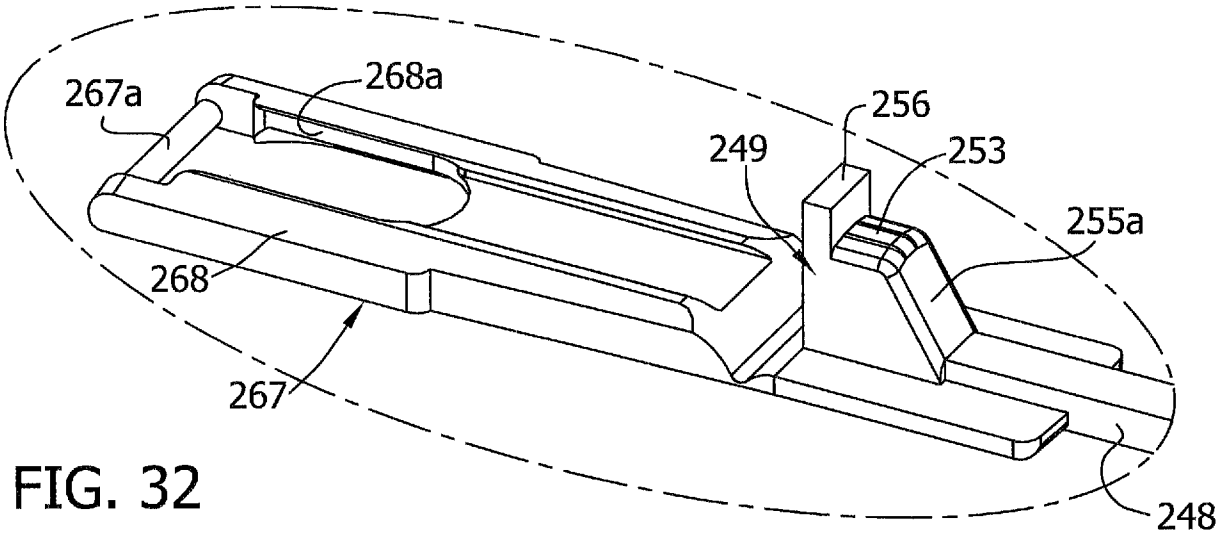
FIG. 32 is an enlarged bottom side perspective of an intermediate connector of the travel bar of FIG. 31.
Figure 33:
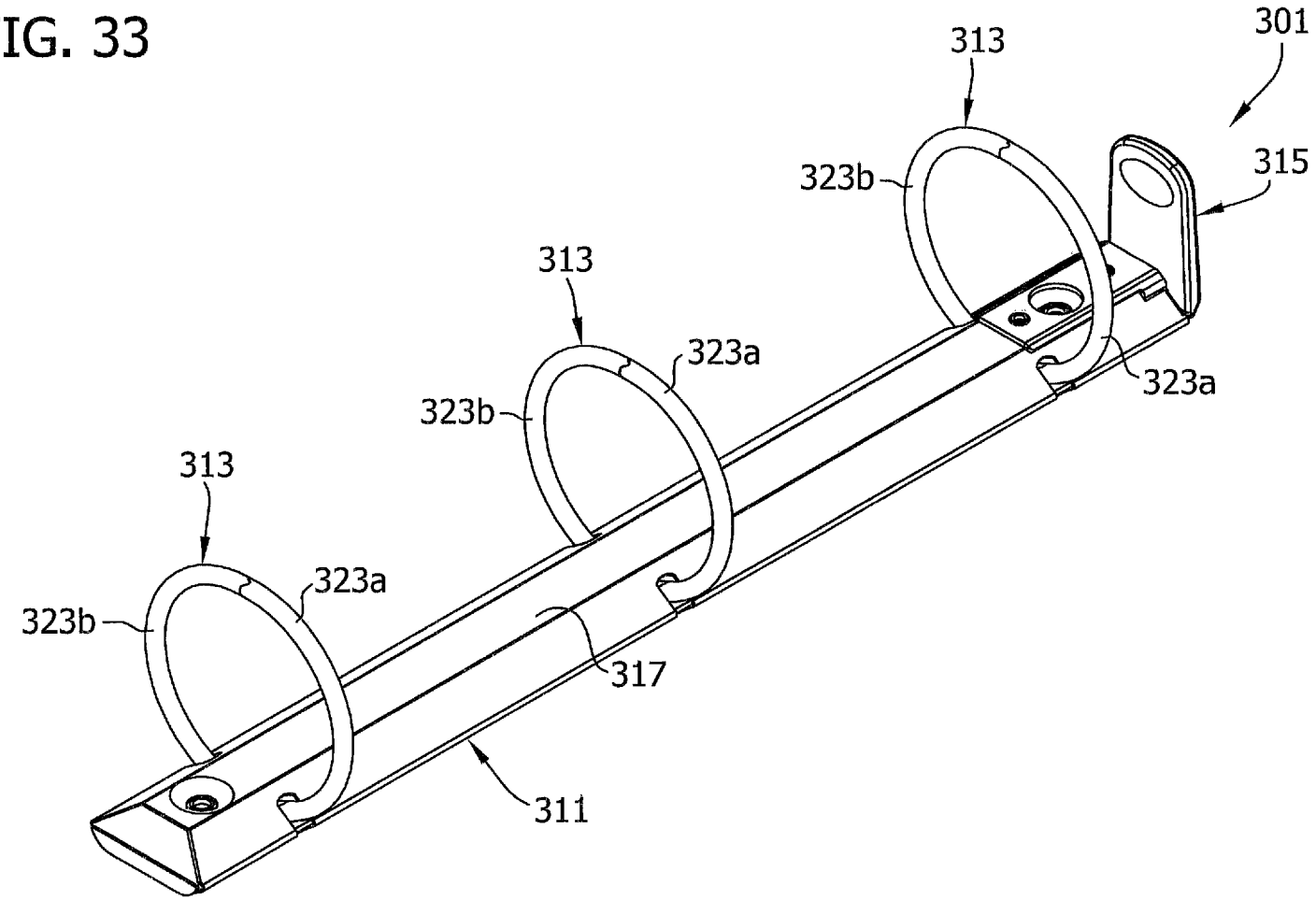
FIG. 33 is a top side perspective of a ring binder mechanism of still another embodiment.
Figure 34:
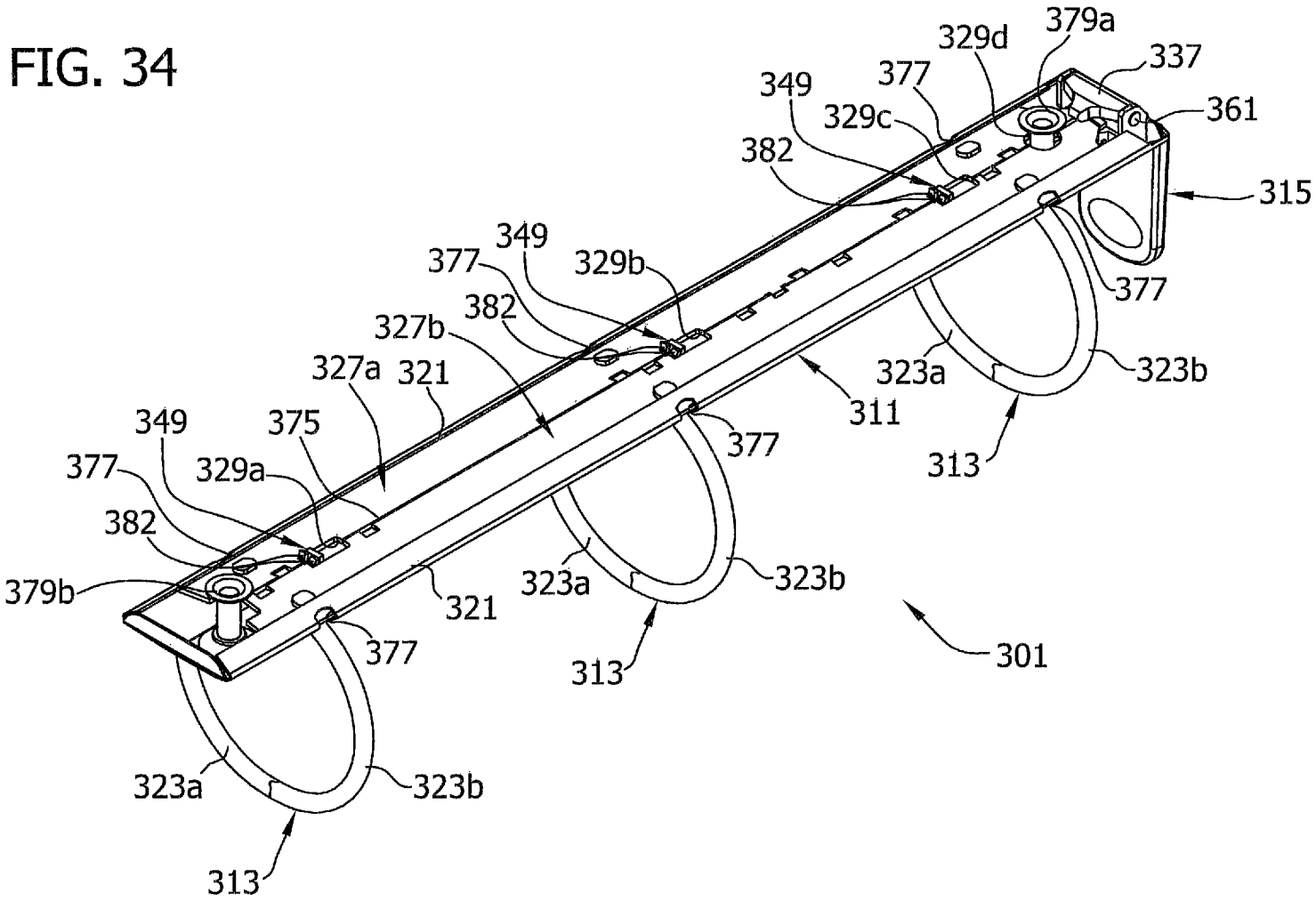
FIG. 34 is a bottom side perspective thereof.

As shown in FIGS. 22, 31, and 32, the illustrated travel bar 245 of this embodiment includes an elongate locking portion 248 having three locking elements 249. An intermediate connector 267 is hingedly connected to the locking portion. The locking elements 249 of the locking portion 248 are shaped similar to the locking elements 49 of the previously described mechanism 1. The intermediate connector 267 is formed with an elongate opening 267*a* for receiving a mounting post 279*a*, 279*b* through the opening and allowing the travel bar 245 to move relative to the mounting post during operation of the mechanism 201. As shown in FIGS. 23 and 25, the intermediate connector 267 connects to a flattened lever 215 (i.e., a lever with a flattened grip as compared to the lever 115 of the previous mechanism (FIGS. 1-19)) at an upper lip 236 of the lever. A cross bar 267*a* of the intermediate connector 267 is captured by a hook 236*a* in the upper lip 236 of the lever 215.

Figure 27:
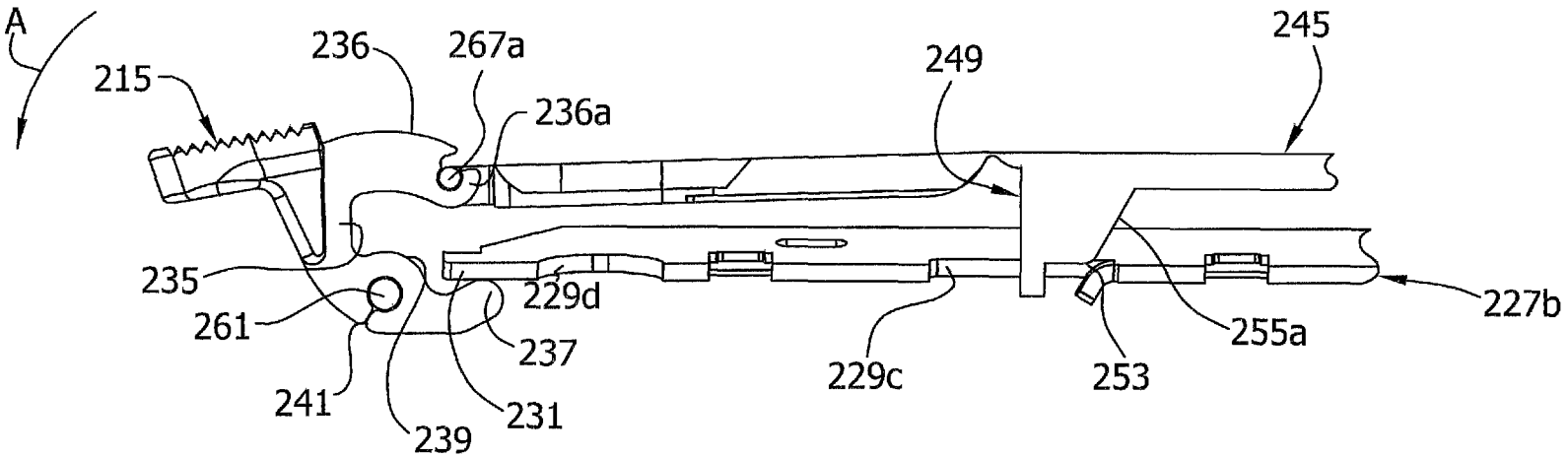
FIG. 27 is similar to FIG. 24 but with the lever at the first deformed position.
Figure 28:
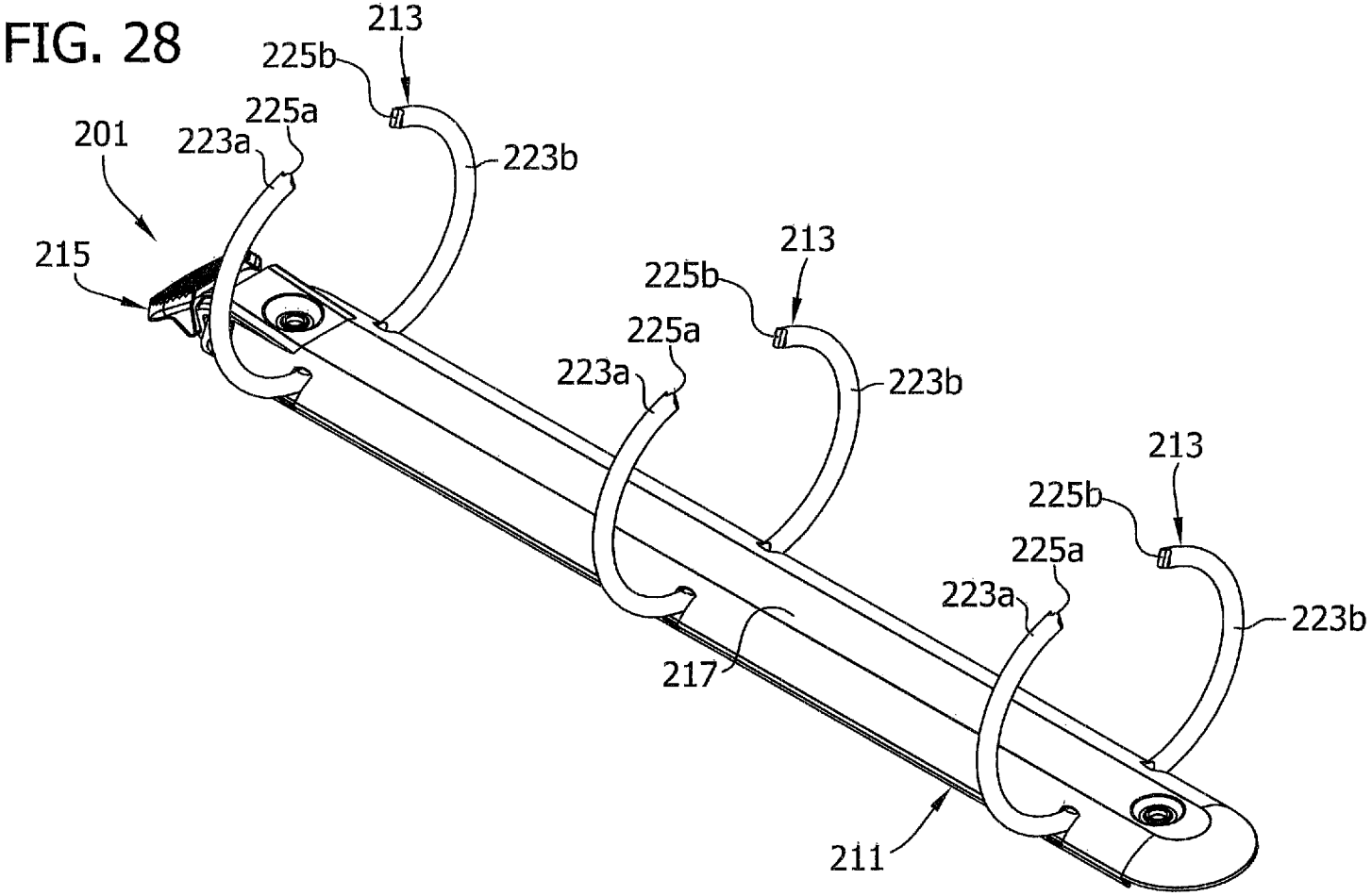
FIG. 28 is a top side perspective of the ring mechanism at the open position.
Figure 29:
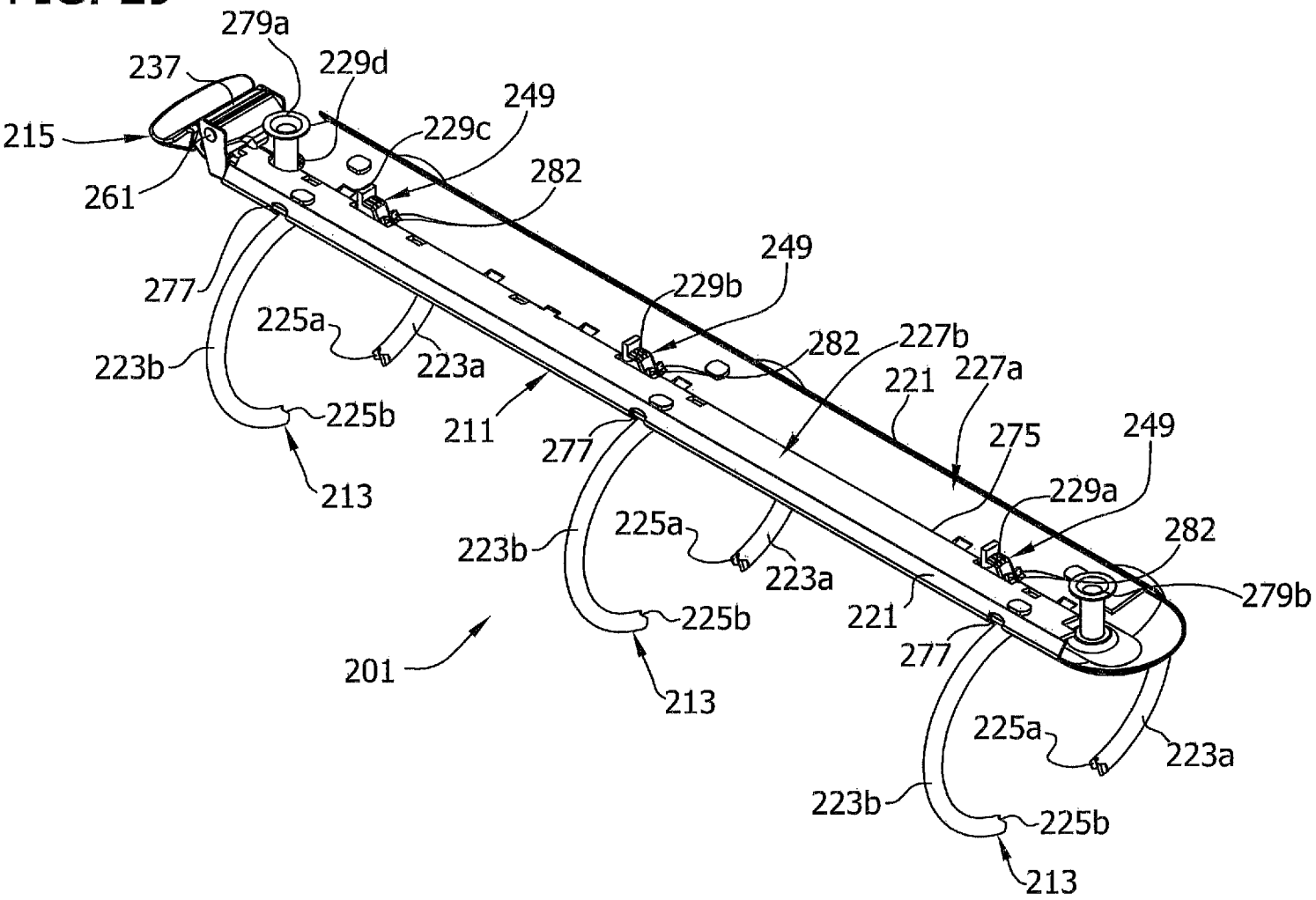
FIG. 29 is a bottom side perspective thereof.
Figure 30:
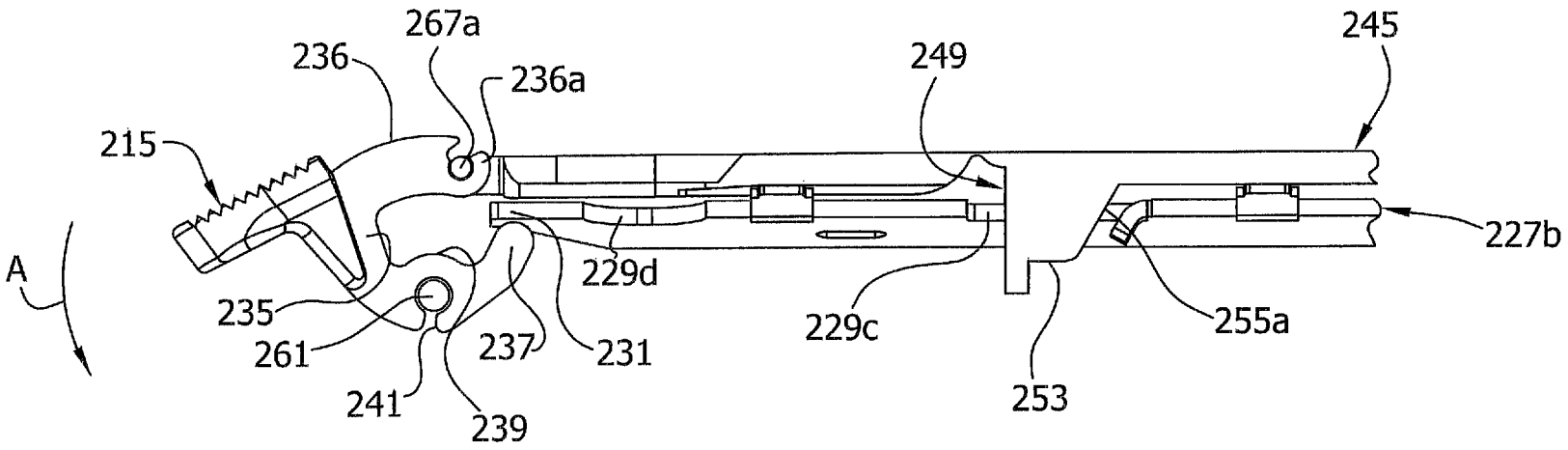
FIG. 30 is similar to FIG. 24 but with the ring mechanism at the open position and with the lever in a second deformed position.

Opening operation of this mechanism 201 is similar to the opening operation of the mechanism 101 previously described (FIGS. 1-19). FIGS. 20-25 illustrate the ring mechanism 201 in a closed and locked position. To open the ring members 223*a*, 223*b*, the lever 215 pivots outward and downward (in a counter-clockwise direction as indicated by the arrow in FIG. 24). As shown in FIG. 27, a lower lip 237 of the lever 215 begins pushing upward on bottom surfaces the hinge plates 227*a*, 227*b* and the upper lip 236 of the lever pulls the travel bar 245 and locking elements 249 to an unlocked position in registration with openings 229*a*, 229*b*, 229*c* in the hinge plates. The hinged connections between the locking portion 248 of the travel bar 245 and the intermediate connector 267 and between the intermediate connector and the lever 215 allow the intermediate connector to pivot slightly upward relative to the locking portion to accommodate slight upward movement of the lever as it pivots. A flexible bridge 239 between a body 235 of the lever 215 and the lower lip 237 of the lever flexes and tensions. An open channel 241 between the body 235 and lower lip 237 closes and the body moves into engagement with the lower lip. Continued opening movement of the lever 215 causes the body to conjointly pivot the lower lip 237, pushing the hinge plates 227*a*, 227*b* upward through the co-planar position. This moves the ring members 223*a*, 223*b* to an open position as shown in FIGS. 28-30. To close the ring members 223*a*, 223*b* and return the mechanism 201 to the locked position, an operator pushes the ring members together.

In this ring mechanism 201, the hinged connection between the intermediate connector 267 and the travel bar 245 shields the locking elements 249 from the slight vertical movement of the lever 215 during pivoting operation of the lever. The hinge 272 provides a pivoting connection between the intermediate connector 267 and locking portion 248 that allows the intermediate connector to pivot upward and downward relative to the locking portion and locking elements 249.

FIGS. 33-53 illustrate a ring binder mechanism 301 according to still yet another embodiment. The mechanism 301 is similar to the mechanism 101 previously described and illustrated in FIGS. 1-19 but includes an intermediate connector 366 different than the intermediate connector 167 of FIGS. 1-19. Parts of the ring mechanism 301 corresponding to parts of the ring mechanism 101 of FIGS. 1-19 are designated by the same reference numerals, plus "200". For example, the mechanism includes a actuating lever 315 mounted by a pin 361 for pivoting movement relative to a housing 311 having a central plateau 317 and bent under rims 321 extending lengthwise along longitudinal edges of the housing. Ring members 323*a*, 323*b* are mounted on hinge plates 327*a*, 327*b*, having longitudinally extending fingers 331 at one end, as described above. The hinge plates 327*a*, 327*b* have cutouts 329*a-d* corresponding to cutouts 129*a-d* described above. The ring members 323*a*, 323*b* extend through openings 377 in the side of the housing 311 and have free ends 325*a*, 325*b* formed to secure the ring members against transverse misalignment when they are closed together. The mechanism 301 also has mounting posts 379*a*, 379*b* that are analogous to the mounting posts 179*a*, 179*b* described above. In this embodiment, the intermediate connector 366 is a bent wire having a first end 366*a*, a second end 366*b*, and an arcuate portion 366*c* intermediate the first and second ends (FIGS. 50-53). The second end 366*b* includes a small gap 366*e* between the beginning and ending points of the wire.

Figure 35:
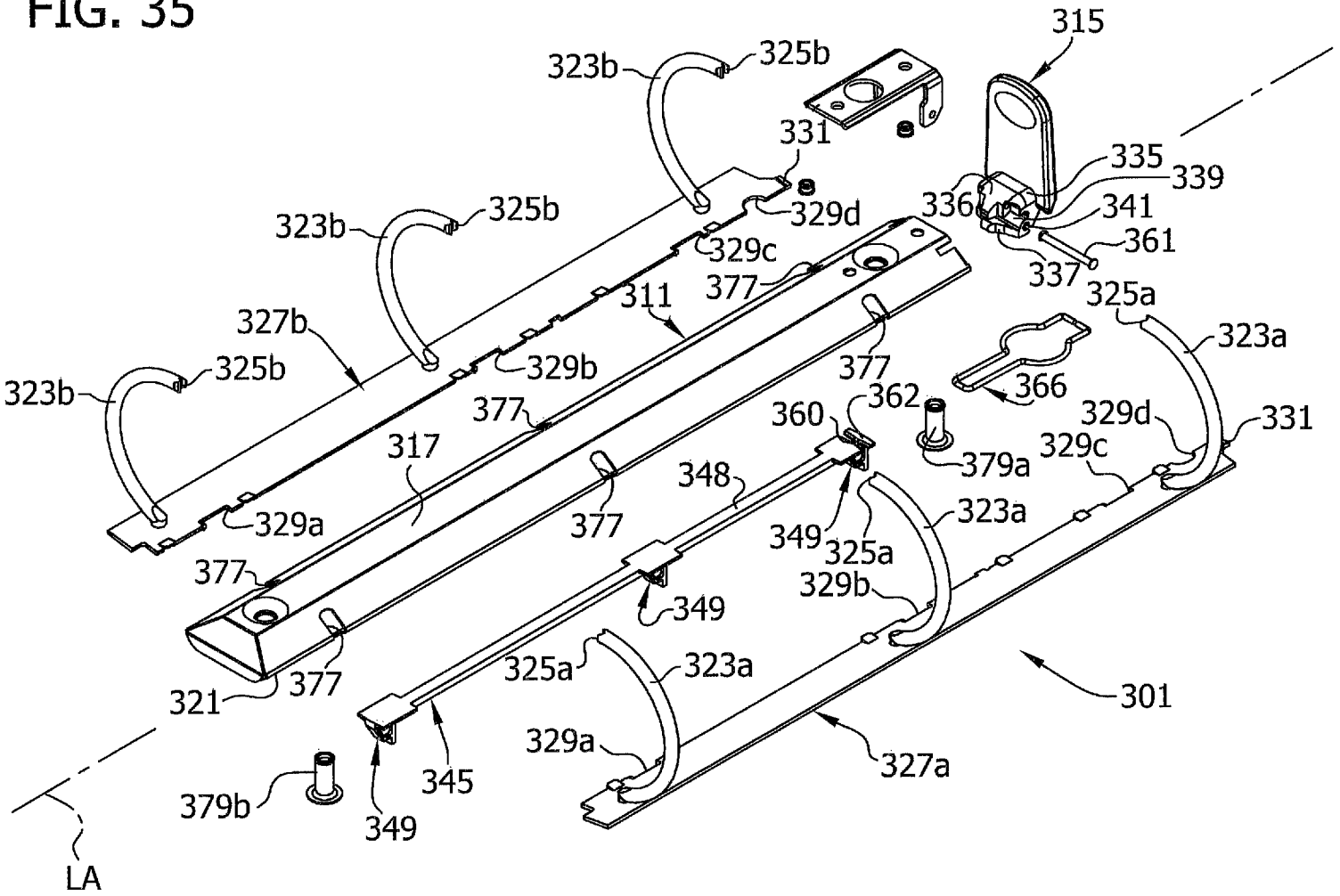
FIG. 35 is an exploded perspective of the ring binder mechanism.
Figure 36:
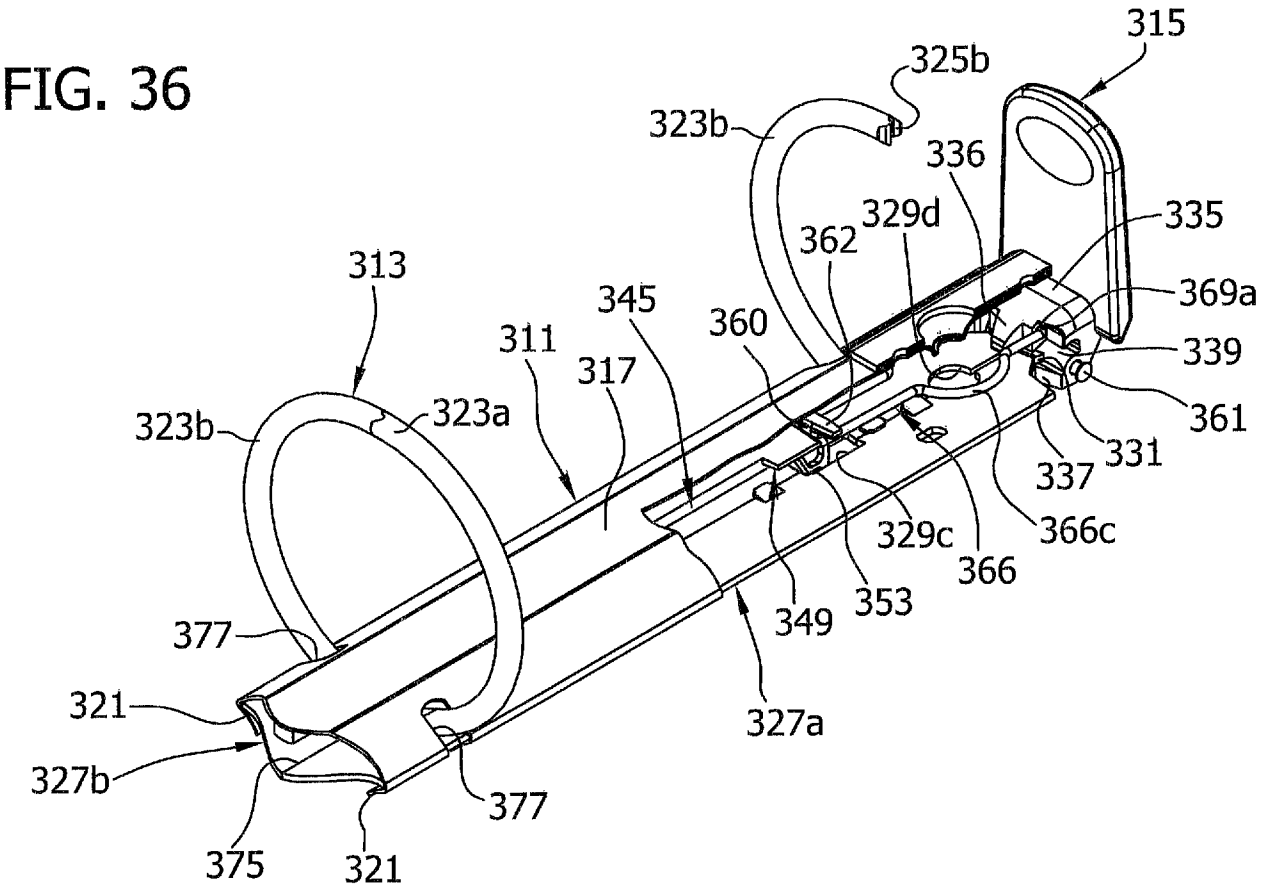
FIG. 36 is an enlarged fragmentary perspective of the ring mechanism of FIG. 33 with a portion of a housing broken away and with a ring member removed to show internal construction.
Figure 37:
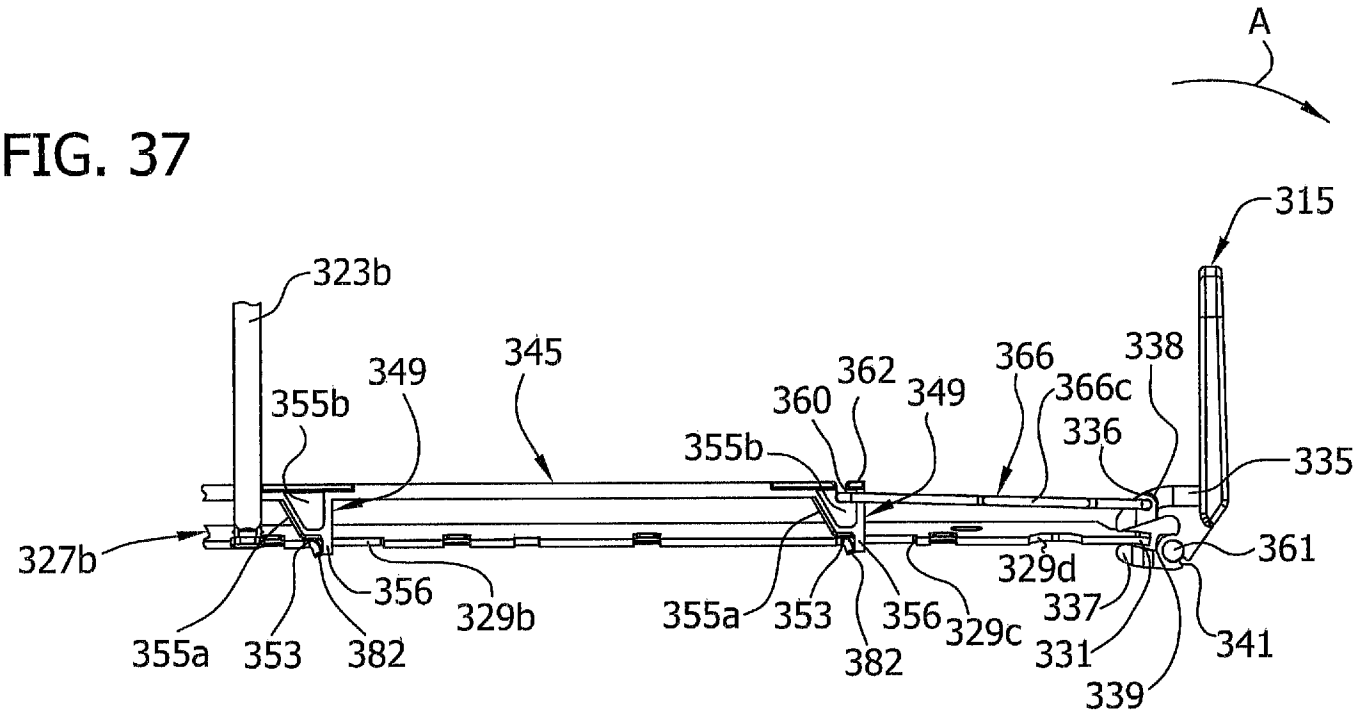
FIG. 37 is a fragmentary side elevation thereof with the housing and a hinge plate removed.
Figure 38:
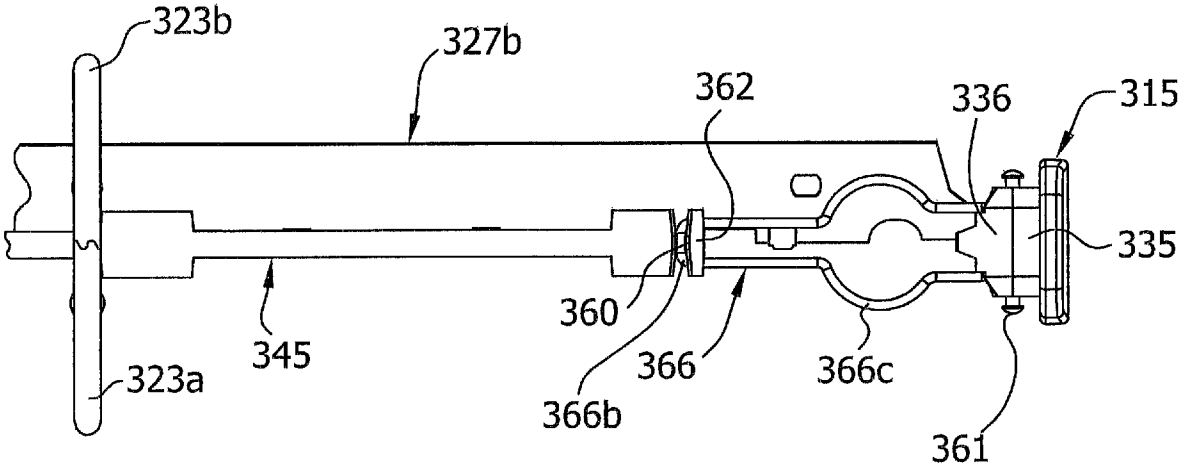
FIG. 38 is a top plan thereof.

As shown in FIGS. 35, 37, and 38, the illustrated travel bar 345 of this embodiment includes an elongate locking portion 348 having three locking elements 349. The intermediate connector 366 is connected to the locking portion 348. More specifically, the locking portion 348 includes a slot 360 and a tab 362 adjacent the slot. The second end 366*b* of the intermediate connector 366 is received in the slot 360 and a portion of the intermediate connector adjacent the second end thereof extends under the tab 362. Besides the slot 360 and tab 362, the locking elements 349 of the locking portion 348 are shaped similar to the locking elements 149 of the previously described mechanism 101. As shown in FIGS. 36-38, the intermediate connector 366 connects to a flattened lever 315 at an upper lip 336 of the lever. The first end 366*a* of the intermediate connector 366 fits within apertures 336*a* in the upper lip 336 of the lever 315 so that pivoting movement of the lever produces translational movement of the travel bar 345.

Figure 39:
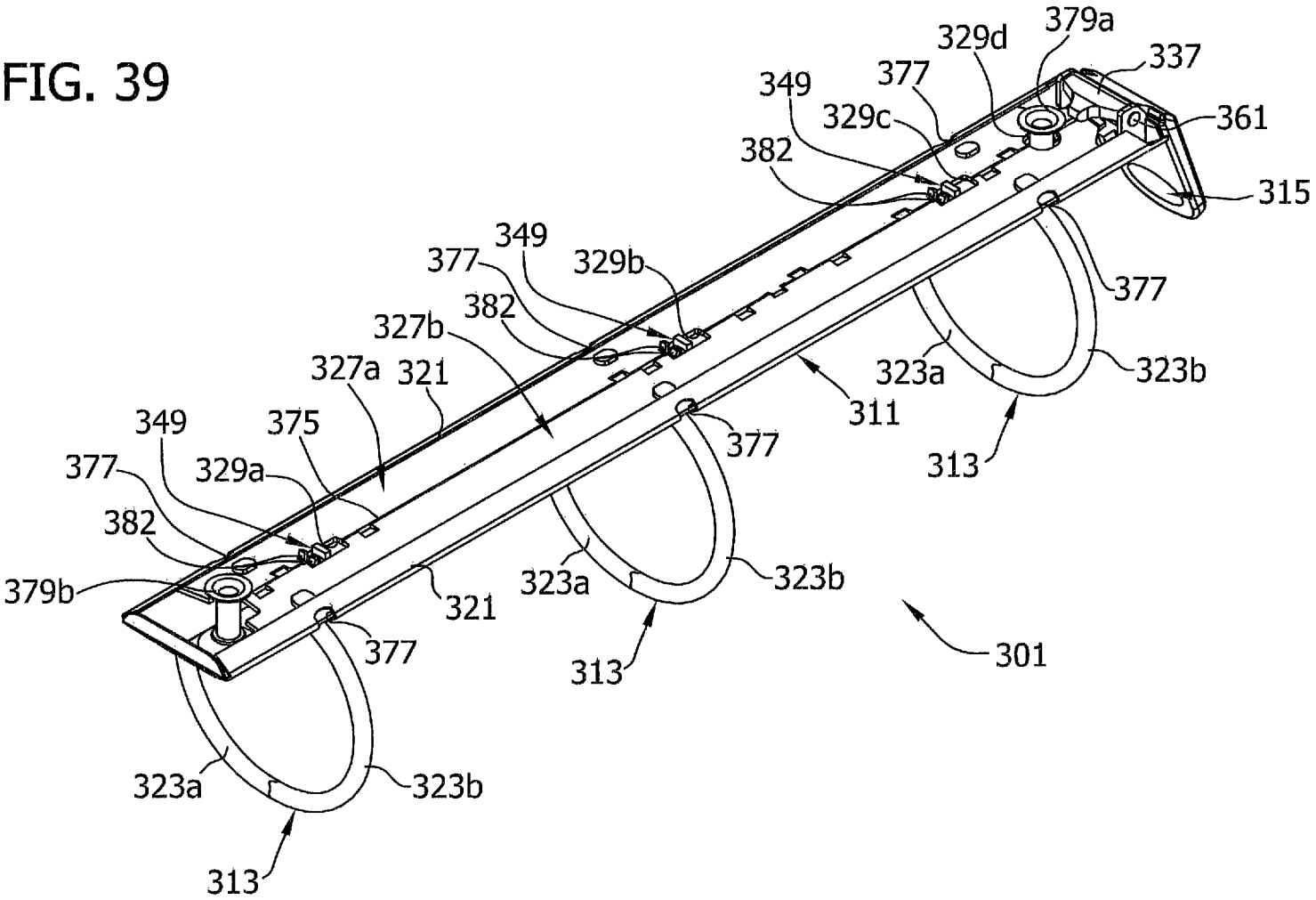
FIG. 39 is a bottom side perspective similar to FIG. 34 but with the lever at a first deformed position.
Figure 40:
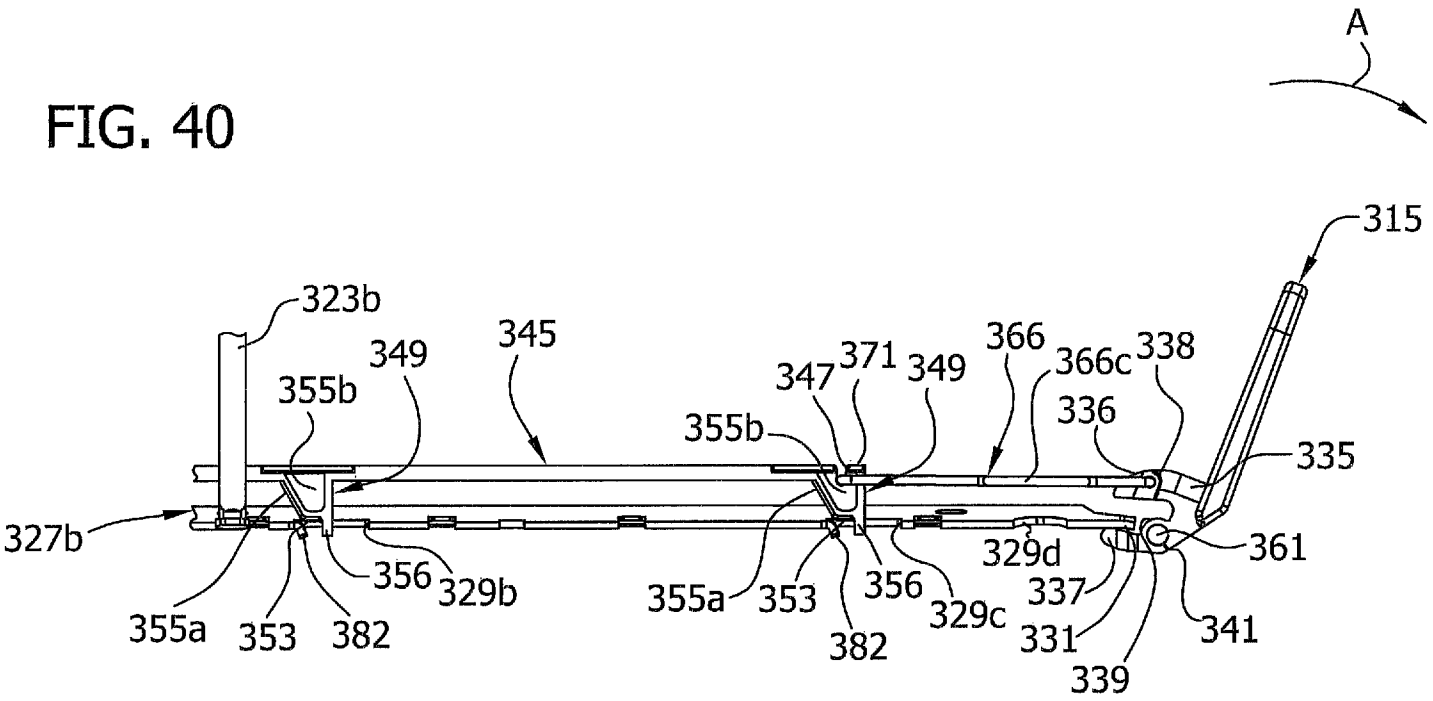
FIG. 40 is a fragmentary side elevation thereof with the housing and a hinge plate removed.
Figure 41:
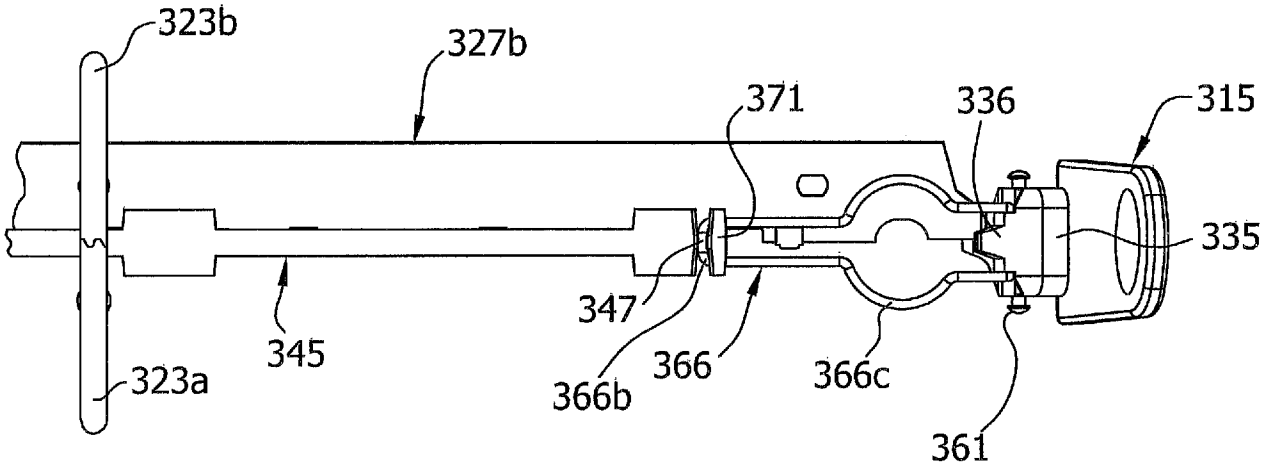
FIG. 41 is a top plan thereof.
Figure 42:
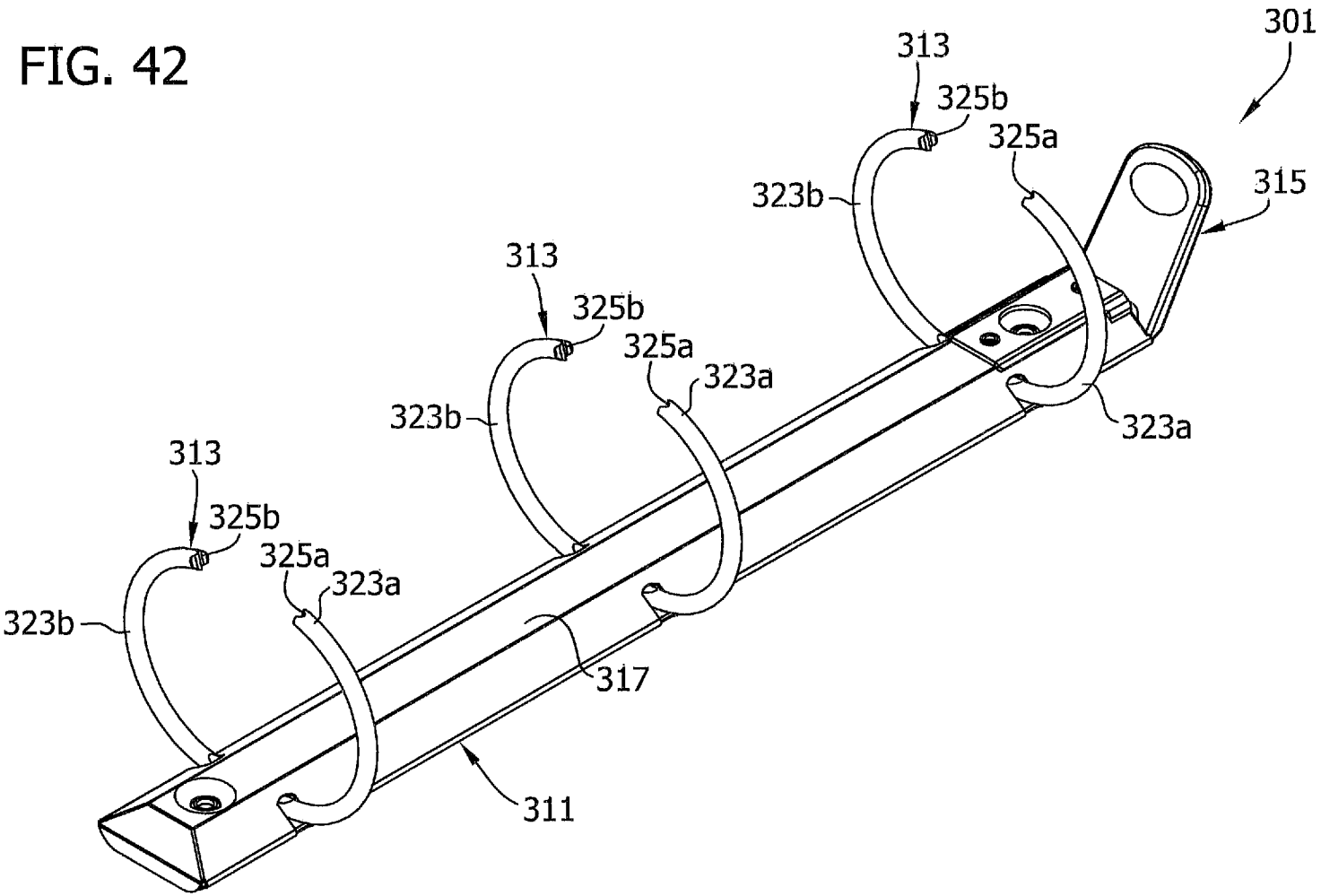
FIG. 42 is similar to FIG. 33 but with the ring mechanism at the open position and with the lever in a second deformed position.
Figure 43:
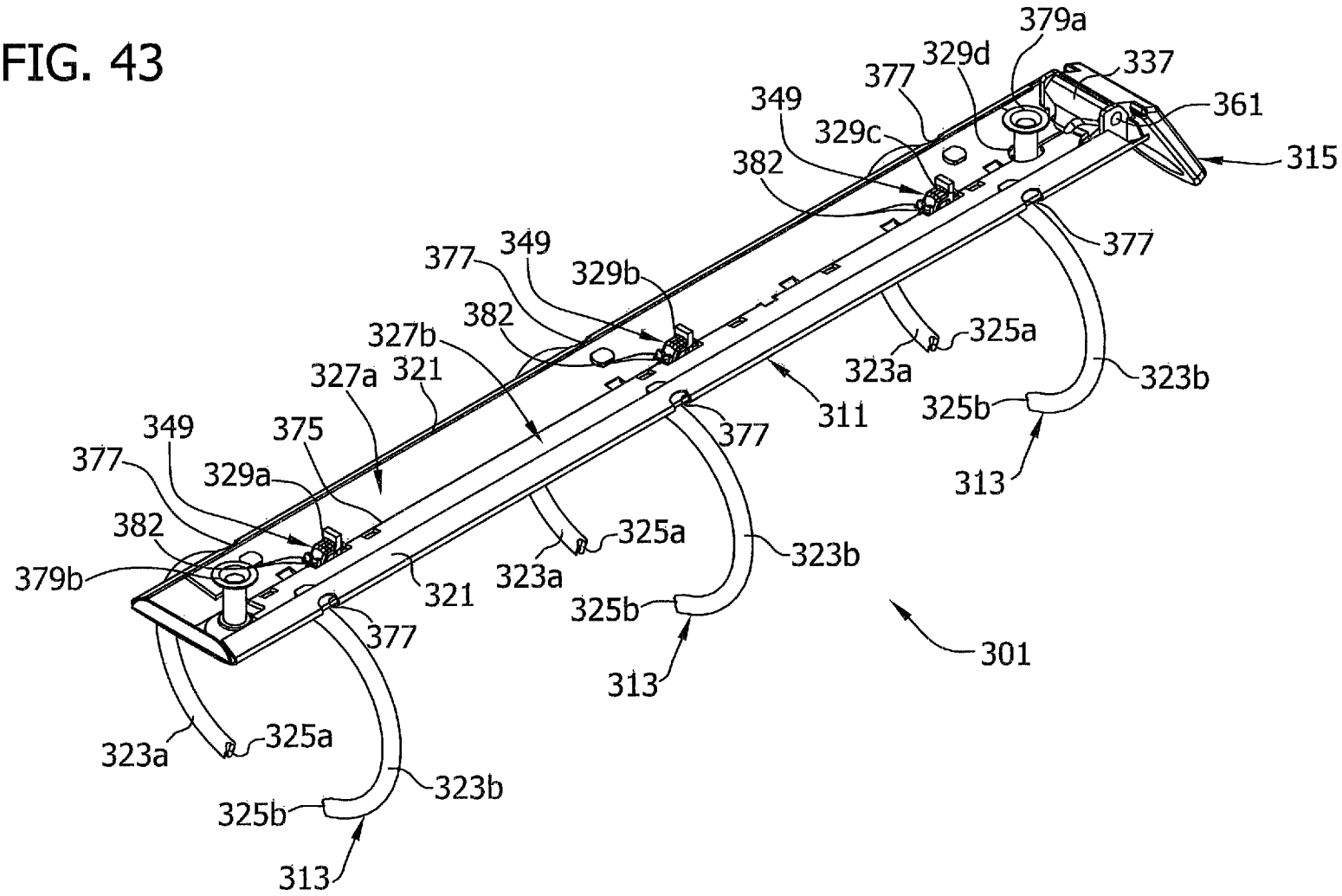
FIG. 43 is a bottom side perspective thereof.
Figure 44:
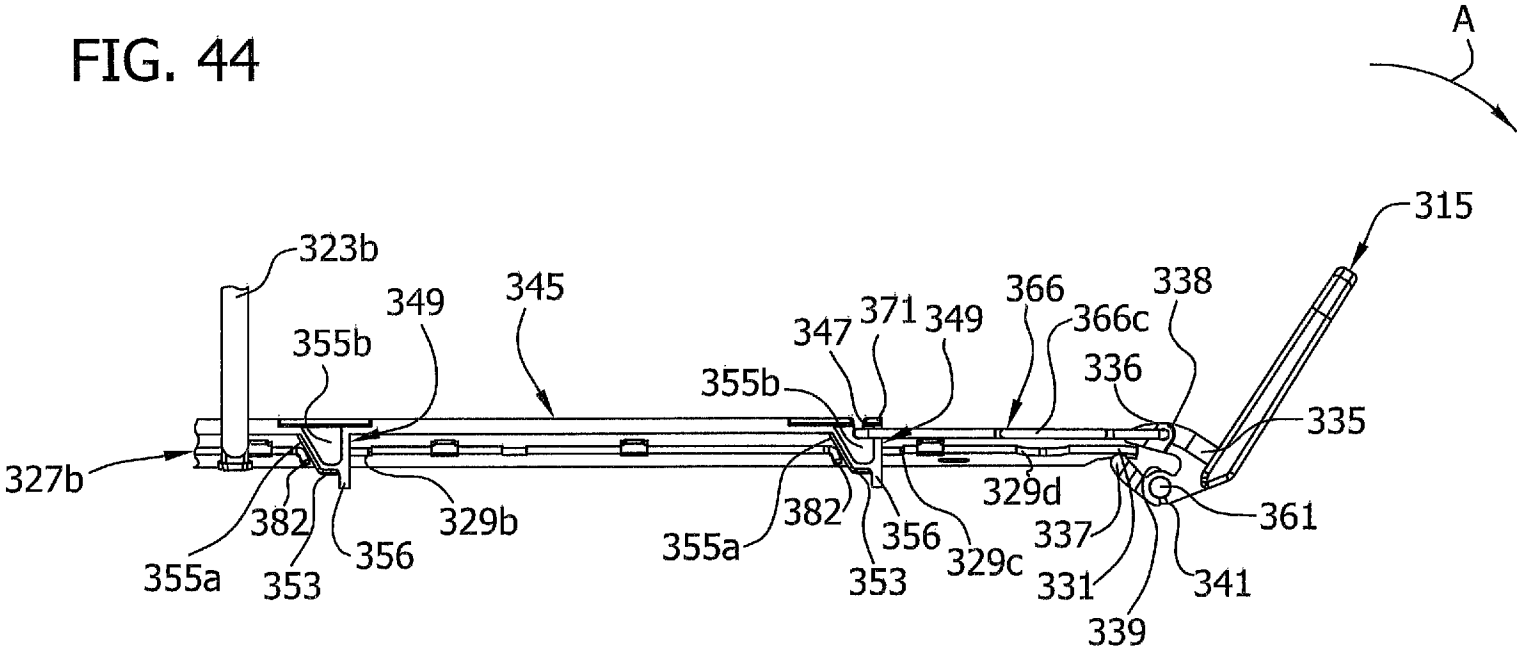
FIG. 44 is a fragmentary side elevation of FIG. 42 thereof with the housing and a hinge plate removed.
Figure 45:
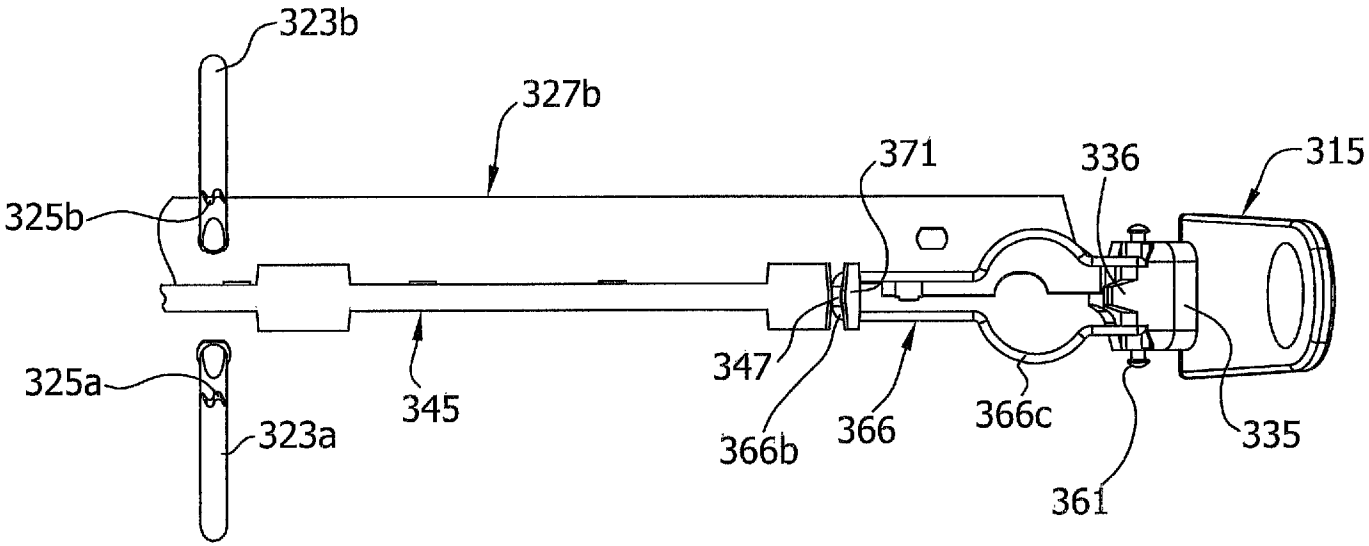
FIG. 45 is a top plan thereof.

Opening operation of this mechanism 301 is similar to the opening operation of the mechanisms 101, 201 previously described (FIGS. 1-32). FIGS. 34 and 36-38 illustrate the ring mechanism 301 in a closed and locked position. To open ring members 323*a*, 323*b*, the lever 315 pivots outward and downward (FIGS. 39-41). As shown in FIG. 39, a lower lip 337 of the lever 315 begins pushing upward on bottom surfaces of hinge plates 327*a*, 327*b* and the upper lip 336 of the lever pulls the travel bar 345 and locking elements 349 to an unlocked position in registration with openings 329*a*, 329*b*, 329*c* in the hinge plates. The connection between the locking portion 348 of the travel bar 345 and the intermediate connector 366 allows the intermediate connector to pivot slightly upward relative to the locking portion to accommodate slight upward movement of the lever 315 as it pivots. A flexible bridge 339 between a body 335 of the lever 315 and the lower lip 337 of the lever flexes and tensions. An open channel 341 between the body 335 and lower lip 337 closes and the body moves into engagement with the lower lip (FIG. 40). Continued opening movement of the lever 315 causes the body to conjointly pivot the lower lip 337, pushing the hinge plates 327*a*, 327*b* upward through the co-planar position. This moves the ring members 323*a*, 323*b* to an open position as shown in FIGS. 42-45. The arcuate portion 366*c* does not substantially deform during movement.

Figure 46:
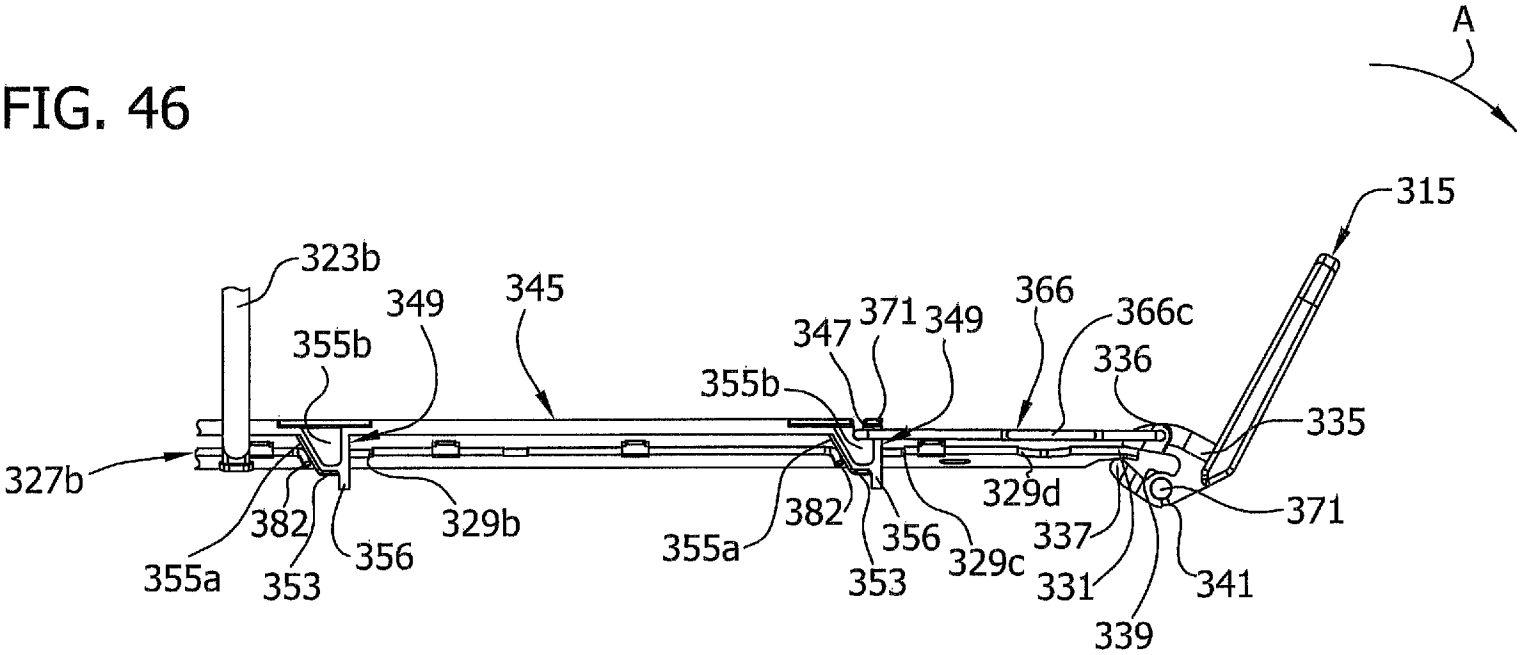
FIG. 46 is the side elevation of FIG. 44 illustrating pivoting movement of the lever to move the mechanism to the closed and locked position and with the lever still deformed.
Figure 47:
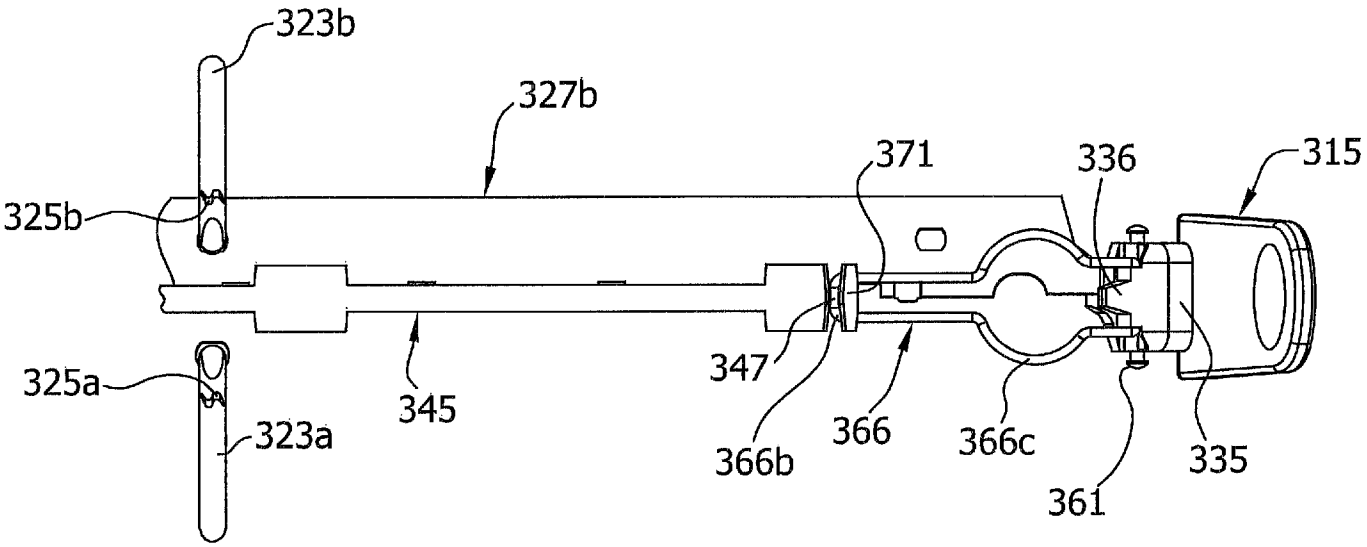
FIG. 47 is a top plan thereof.

To close the ring members 323*a*, 323*b* and return the mechanism 301 to the locked position, an operator can pivot the lever 315 upward and inward. As shown in FIGS. 46 and 47, this moves the upper lip 336 of the lever 315 into contact with the upper surfaces of the hinge plates 327*a*, 327*b* (if it is not already in contact with the hinge plate upper surfaces). The upper lip 336 engages the upper surfaces of the hinge plates 327*a*, 327*b* and begins pushing them downward, but the spring force of a housing 311 of the mechanism 301 resists the initial hinge plate movement. The travel bar 345 may initially move forward with the movement of the upper lip 336 to seat forward edges 355*a* of the locking elements 349 against tabs 382 of the hinge plates 327*a*, 327*b* (if the locking elements are not already seated). As the lever 315 continues to pivot, the seated locking elements 349 resist further translational movement of the travel bar 345.

As shown in FIG. 47, the arcuate portion 366*c* of the intermediate connector 366 compresses (or bows outward to a more pronounced arcuate shape) to allow the lever 315 to continue to pivot. This relative movement between the lever 315 and the locking elements 349 causes tension in the intermediate connector 366. At this instant in the closing movement, if the lever 315 is released before the hinge plates 327*a*, 327*b* pivot downward through their co-planar position (i.e., before the ring members 323*a*, 323*b* close), the tension in the intermediate connector 366 will automatically recoil (and push) the lever back to its starting position. In this ring mechanism 301, the compressibility of the intermediate connector 366 allows the lever 315 to pivot to move the hinge plates 327*a*, 327*b* downward to close the ring members 323*a*, 323*b* before pushing the locking elements 349 to the locked position behind the hinge plates.

Figure 48:
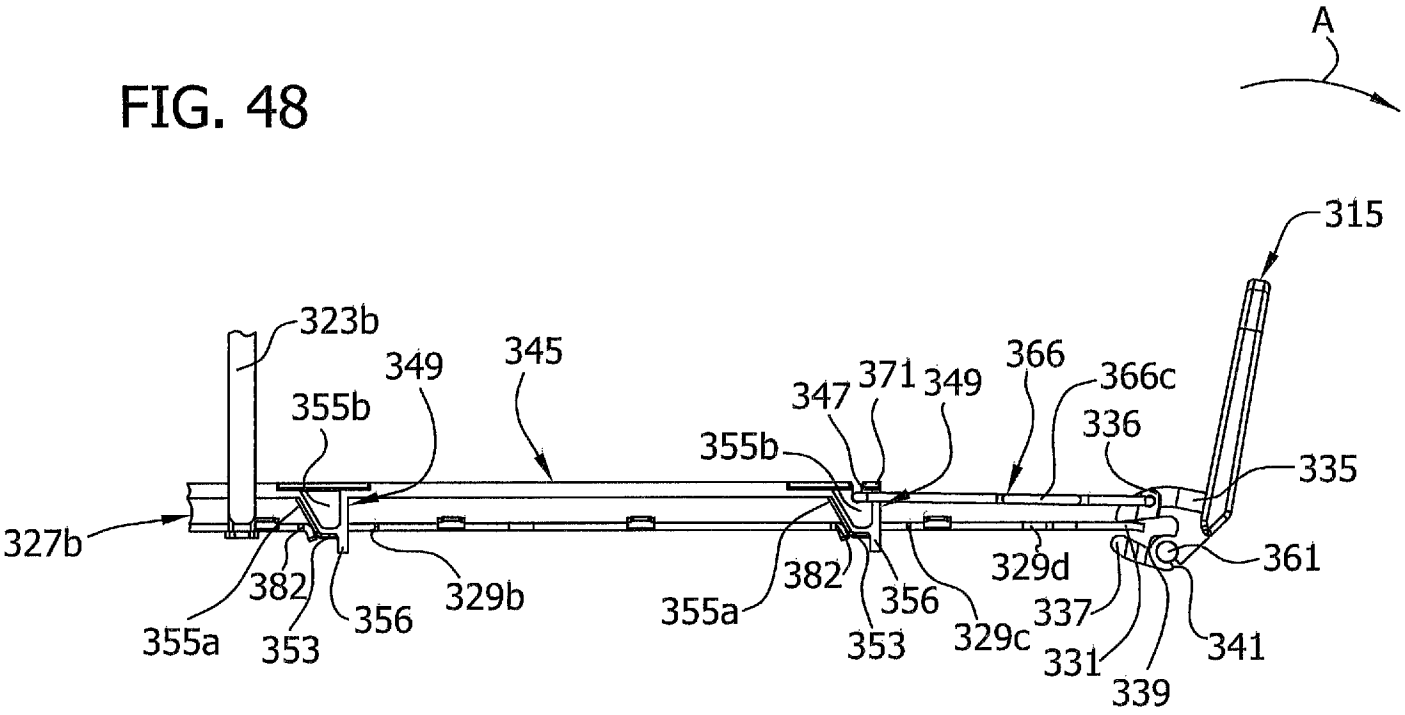
FIG. 48 is the side view of FIG. 46 illustrating pivoting movement of the lever to move the mechanism to the closed and locked position and with an intermediate connector compressed.
Figure 49:
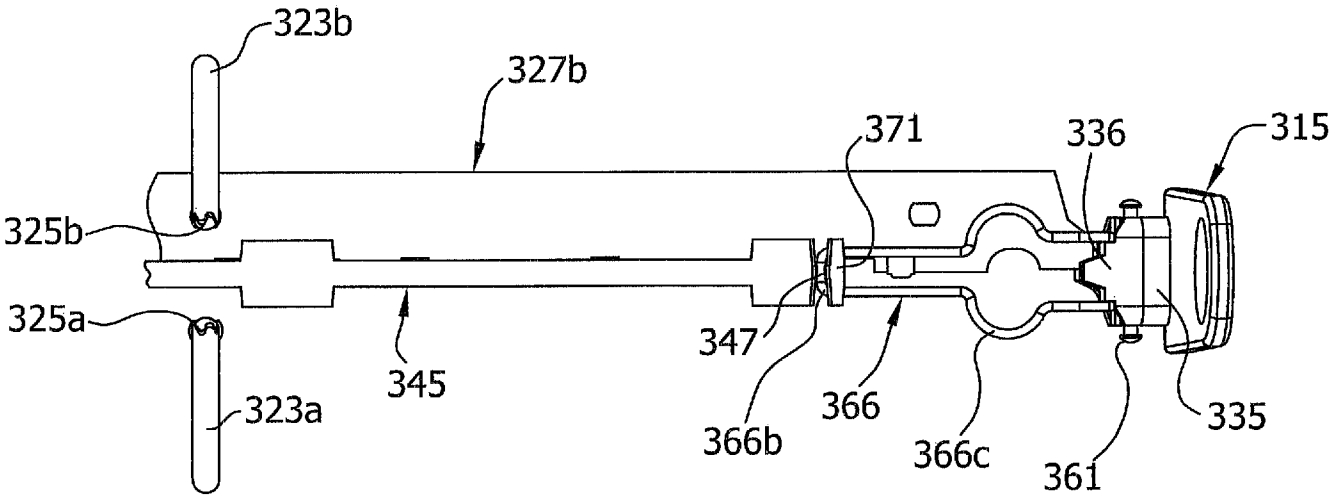
FIG. 49 is a top plan thereof.
Figure 50:
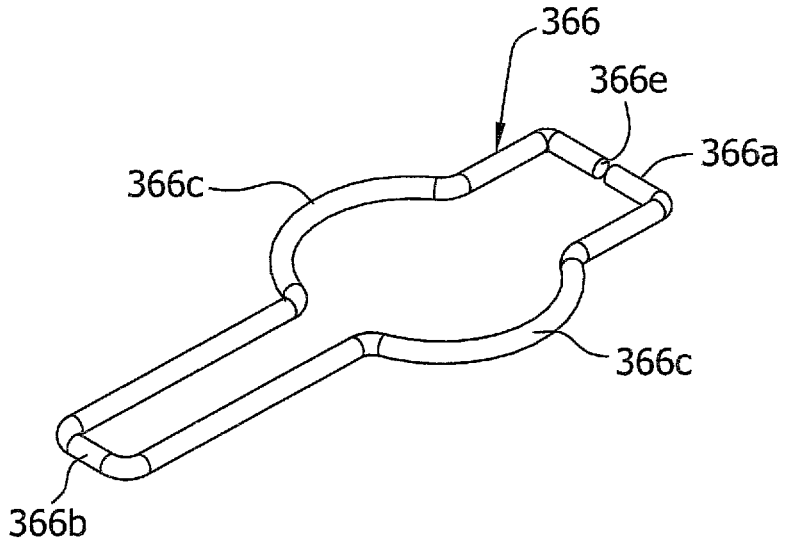
FIG. 50 is a perspective of the intermediate connector.
Figure 51:
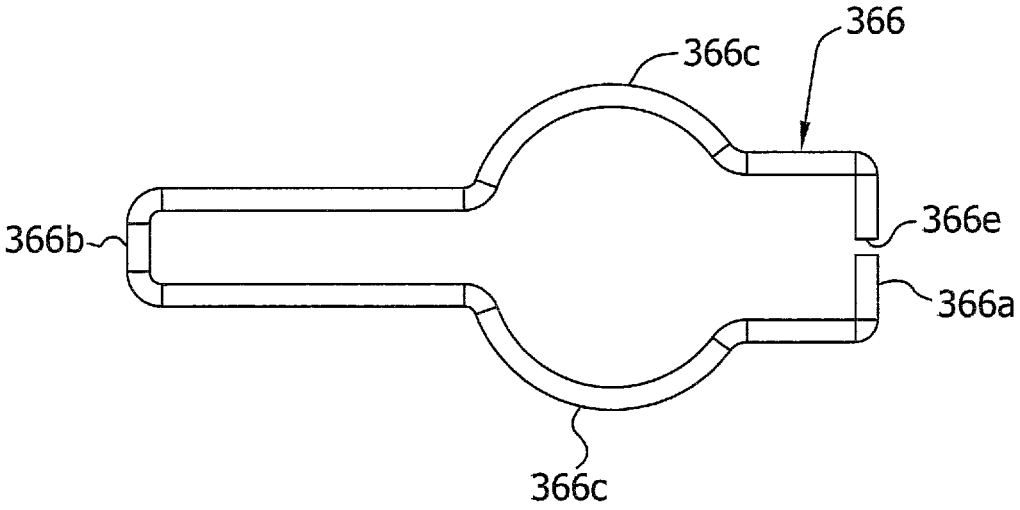
FIG. 51 is a top plan thereof.
Figure 52:
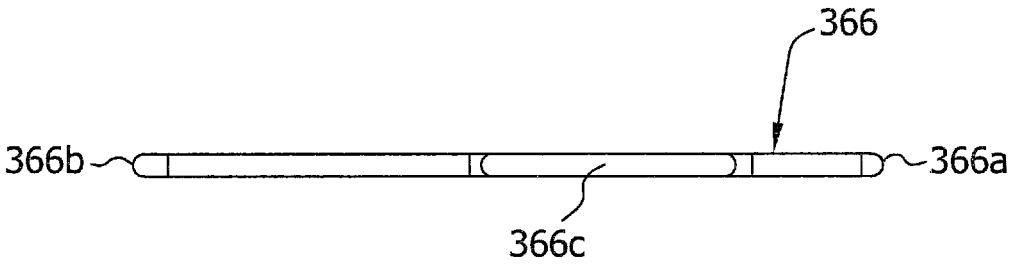
FIG. 52 is a side view thereof.
Figure 53:
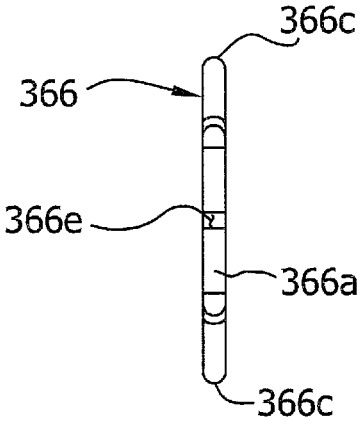
FIG. 53 is an end view thereof.

As shown in FIGS. 48 and 49, continued closing movement of the lever 315 causes the upper lip 336 to pivot the interconnected hinge plates 327*a*, 327*b* downward. Once the hinge plates 327*a*, 327*b* pass just through the co-planar position, the housing's spring force pushes them downward, closing the ring members 323*a*, 323*b*. As the hinge plates 327*a*, 327*b* pivot downward, the angled forward edges 355*a* of the locking elements 349 allow the locking elements and travel bar 345 to move to the left (as viewed in FIGS. 48 and 49). Once the hinge plates 327*a*, 327*b* clear the angled forward edges 355*a* of the locking elements 349, they no longer operate to resist forward movement of the locking elements and travel bar 345. The locking elements 349 now move conjointly with the lever 315 to their locked position behind the hinge plates 327*a*, 327*b*. At the same time, the tension in the intermediate connector 366 caused by it being compressed releases and further pushes the locking elements 349 to the locked position. The bridge 339 and intermediate connector 366 return to their relaxed positions. The mechanism 301 is again in the position shown in FIG. 43.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for retaining loose leaf pages, the mechanism comprising:

an elongate housing having a central portion and sides extending down from the central portion;

first and second hinge plates supported by the housing for pivoting motion relative to the housing;

rings for holding the loose-leaf pages, each ring including a first ring member and a second ring member, the first ring member moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator mounted on the housing for movement relative to the housing for causing pivoting motion of the hinge plates to open the rings, the actuator comprising a lower arm for moving the hinge plates to open the rings and an upper arm for moving the hinge plates to close the rings, the upper arm having a hook thereon, the hook being configured to define a channel having an open side facing the central portion of the housing;

a travel bar;

an intermediate connector connecting the travel bar to the actuator so movement of the actuator to pivot the hinge plates causes longitudinal movement of the travel bar in the housing; and a locking element moveable conjointly with the travel bar between a locking position in which the locking element blocks movement of the hinge plates to open the rings and non-locking position in which the locking element does not block pivoting movement of the hinge plates to open the rings, wherein the intermediate connector comprises a cross bar captured by the hook on the actuator, and wherein the intermediate connector and travel bar are formed as one piece.

2. A ring mechanism as set forth in claim 1 wherein the intermediate connector extends longitudinally in the housing.

3. A ring mechanism as set forth in claim 1 wherein the intermediate connector is hingedly connected to the travel bar.

4. A ring mechanism as set forth in claim 1 wherein the travel bar extends lengthwise of the housing through a space between the hinge plates and the housing.

5. A ring mechanism as set forth in claim 4 wherein the hinge plates have openings and the travel bar extends lengthwise of the housing from one of the openings to another of the openings through the space between the hinge plates and the housing.

6. A ring mechanism as set forth in claim 1 wherein the locking element is formed as one piece with the travel bar and intermediate connector.

7. A ring mechanism as set forth in claim 1 wherein the locking element is a first locking element, the ring mechanism further comprising a second locking element and a third locking element, the second and third locking elements being moveable conjointly with the travel bar between a locking position in which the respective locking element blocks movement of the hinge plates to open the rings and non-locking position in which the respective locking element does not block pivoting movement of the hinge plates to open the rings, the first, second, and third locking elements each being positioned at a different position lengthwise of the housing.

8. A ring binder mechanism as set forth in claim 7 wherein each of the first, second, and third locking elements has a flat bottom and an angled forward edge, the angled forward edge being operable to engage the hinge plates and assist pivoting the hinge plates to close the rings.

9. A ring binder mechanism as set forth in claim 8 wherein the intermediate connector, travel bar, and each of the first, second, and third locking elements are all formed together as one piece.

10. A ring mechanism as set forth in claim 1 wherein the intermediate connector is formed with an elongate opening therein for receiving a mounting post through the opening and allowing the travel bar to move relative to the mounting post.

11. A ring mechanism as set forth in claim 1 wherein the intermediate connector is pivotable relative to the travel bar by the actuator.

12. A ring mechanism as set forth in claim 1 further comprising a pivot pin, the actuator being mounted on the pivot pin for pivoting movement relative to the housing about a fixed pivot connection between the actuator and the housing.

13. A ring mechanism as set forth in claim 1 wherein the open side of the channel extends from one side of the upper arm to an opposite side of the upper arm.

14. A ring mechanism for retaining loose leaf pages, the mechanism comprising:

an elongate housing having a central portion and sides extending down from the central portion;

first and second hinge plates supported by the housing for pivoting motion relative to the housing;

rings for holding the loose-leaf pages, each ring including a first ring member and a second ring member, the first ring member moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator mounted on the housing for movement relative to the housing for causing pivoting motion of the hinge plates to open the rings, the actuator comprising a lower arm for moving the hinge plates to open the rings and an upper arm for moving the hinge plates to close the rings, the upper arm having a hook thereon, the hook being configured to define a channel having an open side facing the central portion of the housing;

a travel bar;

an intermediate connector connecting the travel bar to the actuator so movement of the actuator to pivot the hinge plates causes longitudinal movement of the travel bar in the housing; and a locking element moveable with the travel bar between a locking position in which the locking element blocks movement of the hinge plates to open the rings and nonlocking position in which the locking element does not block pivoting movement of the hinge plates to open the rings, wherein the intermediate connector comprises a cross bar captured by the hook on the actuator, and wherein the intermediate connector has two arms extending to opposite sides of the actuator that connect the travel bar to the opposite ends of the cross bar, and wherein the intermediate connector and travel bar are formed as one piece.

15. A ring mechanism as set forth in claim 14 wherein the actuator is mounted for pivoting movement relative to the housing about a fixed pivot connection with the housing.

16. A ring mechanism as set forth in claim 14 wherein the locking element is a first locking element, the ring mechanism further comprising a second locking element and a third locking element, the second and third locking elements being moveable conjointly with the travel bar between a locking position in which the respective locking element blocks movement of the hinge plates to open the rings and non-locking position in which the respective locking element does not block pivoting movement of the hinge plates to open the rings, the first, second, and third locking elements each being positioned at a different position lengthwise of the housing.

17. A ring binder mechanism as set forth in claim 15 wherein the intermediate connector, travel bar, and each of the first, second, and third locking elements are all formed together as one piece.

* * * * *